US009714126B2

(12) United States Patent
Rye et al.

(10) Patent No.: US 9,714,126 B2
(45) Date of Patent: Jul. 25, 2017

(54) FILTER CLOSURE

(71) Applicant: Mercola.com Health Resources, LLC, Hoffman Estates, IL (US)

(72) Inventors: Steven Andrew Rye, Glendale Heights, IL (US); Paul Mulhauser, New York, NY (US); Kyungmin Andy Lee, New York, NY (US)

(73) Assignee: Mercola.com Health Resources, LLC, Hoffman Estates, IL (US)

( * ) Notice: Subject to any disclaimer, the term of this patent is extended or adjusted under 35 U.S.C. 154(b) by 42 days.

(21) Appl. No.: 14/445,396

(22) Filed: Jul. 29, 2014

(65) Prior Publication Data

US 2016/0031616 A1 Feb. 4, 2016

(51) Int. Cl.

*B65D 51/16* (2006.01)
*B65D 41/04* (2006.01)
*B65D 51/28* (2006.01)

(52) U.S. Cl.

CPC ..... *B65D 51/1616* (2013.01); *B65D 41/04* (2013.01); *B65D 51/1644* (2013.01); *B65D 51/28* (2013.01)

(58) Field of Classification Search

CPC B65D 51/1616; B65D 41/04; B65D 51/1644; B65D 51/28

USPC ..... 220/303, 371, DIG. 33

See application file for complete search history.

(56) References Cited

U.S. PATENT DOCUMENTS 3,961,724 A * 6/1976 Kapsy ..... B60K 15/0406 220/303
6,274,209 B1 * 8/2001 Pagidas ..... B65D 51/1616 206/204
7,048,140 B1 * 5/2006 Caldwell ..... B60T 11/22 215/308
2003/0234254 A1 * 12/2003 Grybush ..... A01D 34/001 220/366.1
2009/0294450 A1 * 12/2009 Schmalz ..... B60K 15/0406 220/371

OTHER PUBLICATIONS

U.S. Appl. No. 29/497,805, filed Jul. 29, 2014, Rye et al.

(Continued)

*Primary Examiner* — James N Smalley

(74) *Attorney, Agent, or Firm* — Reinhart Boerner Van Deuren P.C.

(57) ABSTRACT

A closure is provided. The closure is configured to be coupled to a container having a sidewall extending along a longitudinal axis and defining an open end and an interior. The closure includes a sidewall. The sidewall includes an inner surface and an outer surface. The inner surface includes a coupling feature configured to couple the closure to the sidewall of a container. The closure includes an intermediate wall extending radially inwardly from the sidewall including a first vent aperture. The closure includes an upper closure portion including a second vent aperture. The closure includes a filter layer located between the upper closure portion and the intermediate wall. The closure is configured to prevent gas from travelling in a path generally parallel to the longitudinal axis from the first vent aperture to the second vent aperture.

14 Claims, 34 Drawing Sheets

(56) References Cited

OTHER PUBLICATIONS

Bountiful Gardens, Kitchen Crock Filters Item #32-756, available at http://www.bountifulgardens.org/products.asp?dept=160\, believed to be publically available prior to Jul. 29, 2014, accessed on Jul. 30, 2014, 2 pages.
Leakproof, Odor-Free Stainless Steel Compost Crocks, Filters and Compost Bags, Plow & Hearth, available at http://www.plowhearth.com/leakproof-odor-free-stainless-steel-compost-crocks-filters-and-compost-bags_p6505.html, believed to be publically available prior to Jul. 29, 2014, accessed on Jul. 30, 2014, 3 pages.
Matt Jabs, Kitchen Compost Bucket—DIY, Easy, and Frugal, DIY Natural, available at http://www.diynatural.com/kitchen-compost-bucket-diy-easy-and-frugal/, believed to be publically available prior to Jul. 29, 2014, accessed on Jul. 30, 2014, 31 pages.
FoodSaver® Wide Mouth Jar Sealer, Bed Bath & Beyond, available at http://www.bedbathandbeyond.com/product.asp?sku=12479247&utm_source=google&utm_medium=cpc&device=c&network=g&matchtype=&gclid=CNiF-oCIILgCFcad4AodDCgAdw, believed to be publically available prior to Jul. 29, 2014, accessed on Jul. 30, 2014, 1 page.
Synthetic Filter Discs, Myco Supply—Mushroom Growing Supplies, Tools & Equipment Company, Inc., available at http://www.mycosupply.com/cgi-bin/shopper.cgi?preadd=action&key=SFDI01, believed to be publically available prior to Jul. 29, 2014, accessed on Jul. 30, 2014, 2 pages.
Holmes Replacement Wick Humidifier Filter, Blain's Farm & Fleet, available at http://www.farmandfleet.com/products/436286-holmes-replacement-wick-humidifier-filter.html#.UdSFDG3Np8E, believed to be publically available prior to Jul. 29, 2014, accessed on Jul. 30, 2014, 1 page.
Sprout People, available at http://www.sproutpeople.com/devices/jar/jar.html, believed to be publically available prior to Jul. 29, 2014, accessed on Jul. 30, 2014, 2 pages.
Friis Freshness Valve, Friis Coffee, available at http://www.friiscoffee.com/friis-freshness-valve/, believed to be publically available prior to Jul. 29, 2014, accessed on Jul. 30, 2014, 3 pages.
Odor-Free Compost Keeper Bamboo Pail with Filter, 3 Quart, A.M. Leonard's Gardeners Edge, available at http://www.gardenersedge.com/bamboo-kitchen-compost-bucket/p/CCB/, believed to be publically available prior to Jul. 29, 2014, accessed on Jul. 30, 2014, 2 pages.
BNTO Canning Jar Lunchbox Adaptor—Wide Mouth—6oz—Clear, Cuppow, available at http://www.cuppow.com/collections/bnto-jar-lunchbox-adaptors/products/bnto-04, believed to be publically available prior to Jul. 29, 2014, accessed on Jul. 30, 2014, 1 page.
0ne-way bubbler vent on yeast fermenting container, believed to be publically available prior to Jul. 29, 2014, http://www.youtube.com/watch?v=x3fRZielMxQ.
Dana Tucker, How to Ferment Vegetables, available at http://fermentingvegetables.blogspot.com/2012/07/do-you-want-easy-and-convenient-way-to.html#.Ubd-maP4Jsl, Jul. 21, 2012, believed to be publically available prior to Jul. 29, 2014, accessed on Jul. 30, 2014, 4 pages.
Product Information, Gremarco, available at http://www.hibco.com/, believed to be publically available prior to Jul. 29, 2014, accessed on Jul. 30, 2014, 1 page.
Hibco Plastics, available at http://www.gremarco.com/products.php, believed to be publically available prior to Jul. 29, 2014, accessed on Jul. 30, 2014, 1 page.
Getter®, ADCOA (Adsorbents & Desiccants Corporation of America), available at http://catalog.adcoa.net/viewitems/activated-charcoal/getter-?&bc=100l1008, believed to be publically available prior to Jul. 29, 2014, accessed on Jul. 30, 2014, 2 pages.
American Activated Carbon Corp, available at http://www.aacarbon.com/activated-carbon-america.html?scrollto=aac, believed to be publically available prior to Jul. 29, 2014, accessed on Jul. 30, 2014, 3 pages.
Filtration Net, Industrial Netting, available at http://www.industrialnetting.com/filtration.htm, believed to be publically available prior to Jul. 29, 2014, accessed on Jul. 30, 2014, 2 pages.
Calgon Carbon, available at http://www.calgoncarbon.com/index.php, believed to be publically available prior to Jul. 29, 2014, accessed on Jul. 30, 2014, 1 page.
How to Know When Your Fermented Vegetables Are Ready for Cold Storage, Cultures for Health, available at http://www.culturesforhealth.com/how-to-know-fermented-vegetables-ready-cold-storage, believed to be publically available prior to Jul. 29, 2014, accessed on Jul. 30, 2014, 2 pages.
When Do Fermented Foods Go Bad? Our Most Frequently Asked Questions on This Topic Answered, Body Ecology, available at http://bodyecology.com/articles/fermented_foods_frequently_asked_questions.php#.UbEcBKP4Jsl, Oct. 20, 2007, believed to be publically available prior to Jul. 29, 2014, accessed on Jul. 30, 2014, 2 pages.
Paul Jaminet, Fermented Mixed Vegetables, Perfect Health Diet, available at http://perfecthealthdiet.com/2011/11/fermented-mixed-vegetables/, Nov. 27, 2011, believed to be publically available prior to Jul. 29, 2014, accessed on Jul. 30, 2014, 10 pages.
How to Ferment Vegetables: The Basic Culturing Process, Cultures for Health, available at http://www.culturesforhealth.com/how-to-naturally-culture-ferment-vegetables, believed to be publically available prior to Jul. 29, 2014, accessed on Jul. 30, 2014, 2 pages.

* cited by examiner

FILTER CLOSURE

BACKGROUND OF THE INVENTION

The present invention relates generally to the field of closures. The present invention relates specifically to closures configured to vent gasses, such as, for example gasses generated within containers.

Fermenting is becoming an increasingly popular method of preserving food, e.g., vegetables, etc. A growing, health-minded market may appreciate nutritional benefits of cost-effectively creating probiotic foods, such as fermented foods. Foods may be fermented, for example, in containers.

SUMMARY OF THE INVENTION

One embodiment of the invention relates to a closure configured to be coupled to a container having a sidewall extending along a longitudinal axis and defining an open end and an interior. The closure includes a sidewall including an inner surface and an outer surface. The inner surface includes a coupling feature configured to couple the closure to the sidewall of a container. The closure includes an intermediate wall extending radially inwardly from the sidewall. The intermediate wall includes a first vent aperture. The closure includes an upper closure portion including a second vent aperture. The closure includes a filter layer located between the upper closure portion and the intermediate wall. The closure is configured to prevent gas from travelling in a path generally parallel to the longitudinal axis from the first vent aperture to the second vent aperture.

Another embodiment of the invention relates to a closure configured to be coupled to a container having a sidewall extending along a longitudinal axis from a first open end to a second end and defining an interior. The closure includes a filter. The closure includes a compartment enclosing the filter in its interior. The compartment is defined by an upper wall and a lower wall. The lower wall includes a first through bore. The upper wall includes a second through bore. The second through bore extends from an inner aperture in the interior of the upper wall in communication with the interior compartment and an outer aperture in the exterior of the upper wall in communication with the exterior of the closure. The closure includes a sidewall having an interior surface and an exterior surface. The interior surface includes a coupling feature configured to couple the closure to the sidewall of the container. The first through bore extends along a first axis. The second through bore extends along a second axis. The first axis and the second axis are non-coaxial.

Another embodiment of the invention relates to a closure configured to be coupled to a container having a sidewall extending from a first open end to a second end. The closure includes a lower portion including a first sidewall extending along a longitudinal axis from a first end to a second end and a wall extending at an axial location between the first end of the first sidewall and the second end of the first sidewall. The wall includes a first vent. The first sidewall is configured to be coupled to the container. The closure includes a valve configured to regulate fluid flow through the first vent. The closure includes a filter. The closure includes an upper portion. The upper portion includes a second sidewall extending from a first open end to a second end and an end wall. The end wall includes a second vent. The second sidewall is configured to be coupled to the first sidewall to enclose the filter between the lower portion and the upper portion. The first vent and the second vent are each located at different radial locations relative to the longitudinal axis.

Another embodiment of the invention relates to a container. The container includes a first sidewall defining a first open end. The container includes an end wall closing a second end of the first sidewall. The first sidewall and the end wall define a container chamber configured to receive vegetables to be fermented therein. The first sidewall has a threaded portion. The container includes a closure. The closure includes a second sidewall having a threaded portion configured to threadingly engage with the threaded portion of the first sidewall to couple the closure to the sidewall and close the first open end of the first sidewall. The closure includes an intermediate wall extending radially inwardly from the sidewall. The intermediate wall defines a first vent therethrough. The closure includes a valve configured to regulate gas flow through the first vent and to deter liquid flow through the first vent. The closure includes an upper wall defining a second vent therethrough. The upper wall and the intermediate wall define a filter chamber therebetween. The closure includes a filter located in the filter chamber. The intermediate wall and the valve are configured to isolate the filter from liquid and solid contents of the container chamber will allowing gas from the filter chamber to pass through the first vent to the filter.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a closure are shown. Fermenting of food, e.g., vegetables, may be done in a container such as a jar, e.g., glass jar, mason jar, etc. Food may be added to the container, along with an inoculant, e.g., starter culture, kefir grains, whey, etc. The container of food and inoculant may be maintained at a temperature of between approximately 68° Fahrenheit and approximately 85° Fahrenheit for between approximately 1 day and approximately three weeks to allow the food to ferment. During this period, gas is created in the interior of the container by the fermentation process. It may be advantageous to allow the gas to be released from the interior of the container in a controlled manner, at various times throughout the fermentation period, etc. Additionally, it may be advantageous to prevent environmental oxygen and other gases from entering the interior of the container during fermentation, which may promote mold growth inside the container. Gases that are to be released from the interior of the container, e.g., fermentation gases, may have an objectionable and/or noxious odor. Additionally, facilitating the emission of byproduct noxious fumes created during the fermentation process over the time of the fermentation process may reduce the bolus effect, e.g., release of large amount of gas at a single time, of odor release when opening a container and releasing all of the byproduct noxious fumes at the time of opening.

Embodiments of closures described herein are configured to be coupled to containers, e.g., containers containing food such as vegetables to be fermented, to prevent entry of environmental oxygen and other gases into the interior of the container while allowing release of gases produced in the interior of the container during fermentation from the container. Embodiments of closures described herein also include a filter. The closures are configured such that the gases from the interior of the container take a path through the filter configured to reduce the objectionable and/or noxious odor of the gases. In one embodiment, the filter of a closure can be replaced, and the closure can be reused.

Figure 1:
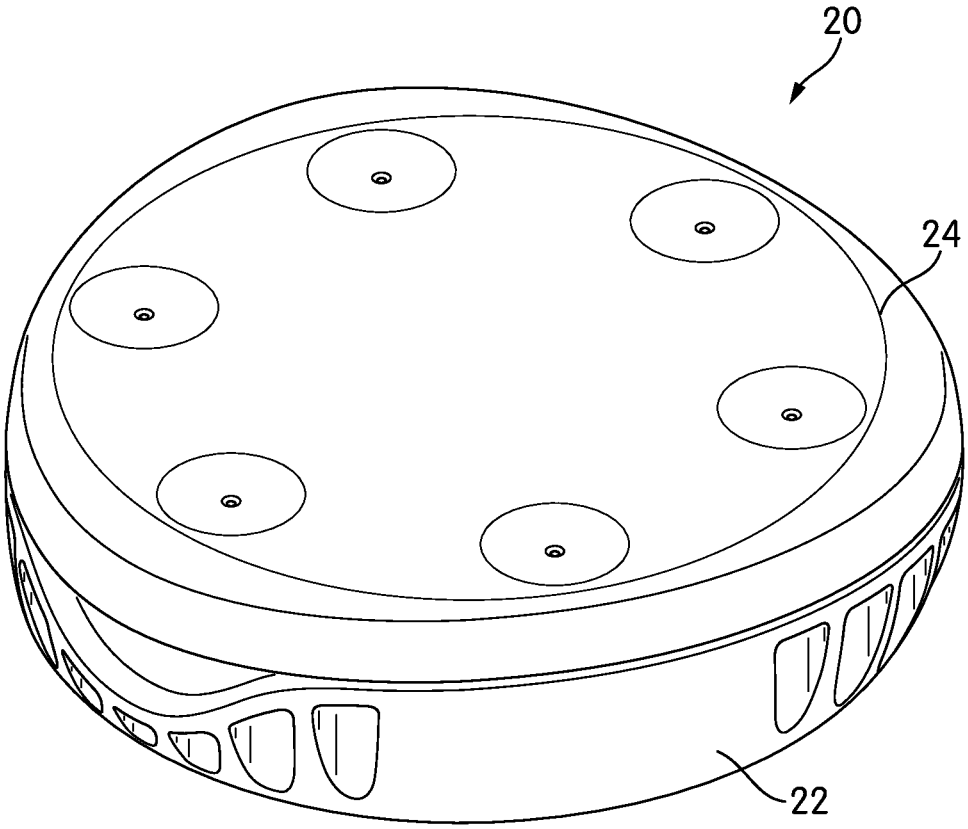
FIG. 1 is a perspective view of a closure according to an exemplary embodiment.

Referring to FIG. 1, an embodiment of a closure 20 is illustrated. The closure 20 is configured to be coupled to a container, e.g., glass mason jar, etc., to close an open end of the container. The closure 20 includes a lower closure portion 22 and an upper closure portion 24.

Figure 2:
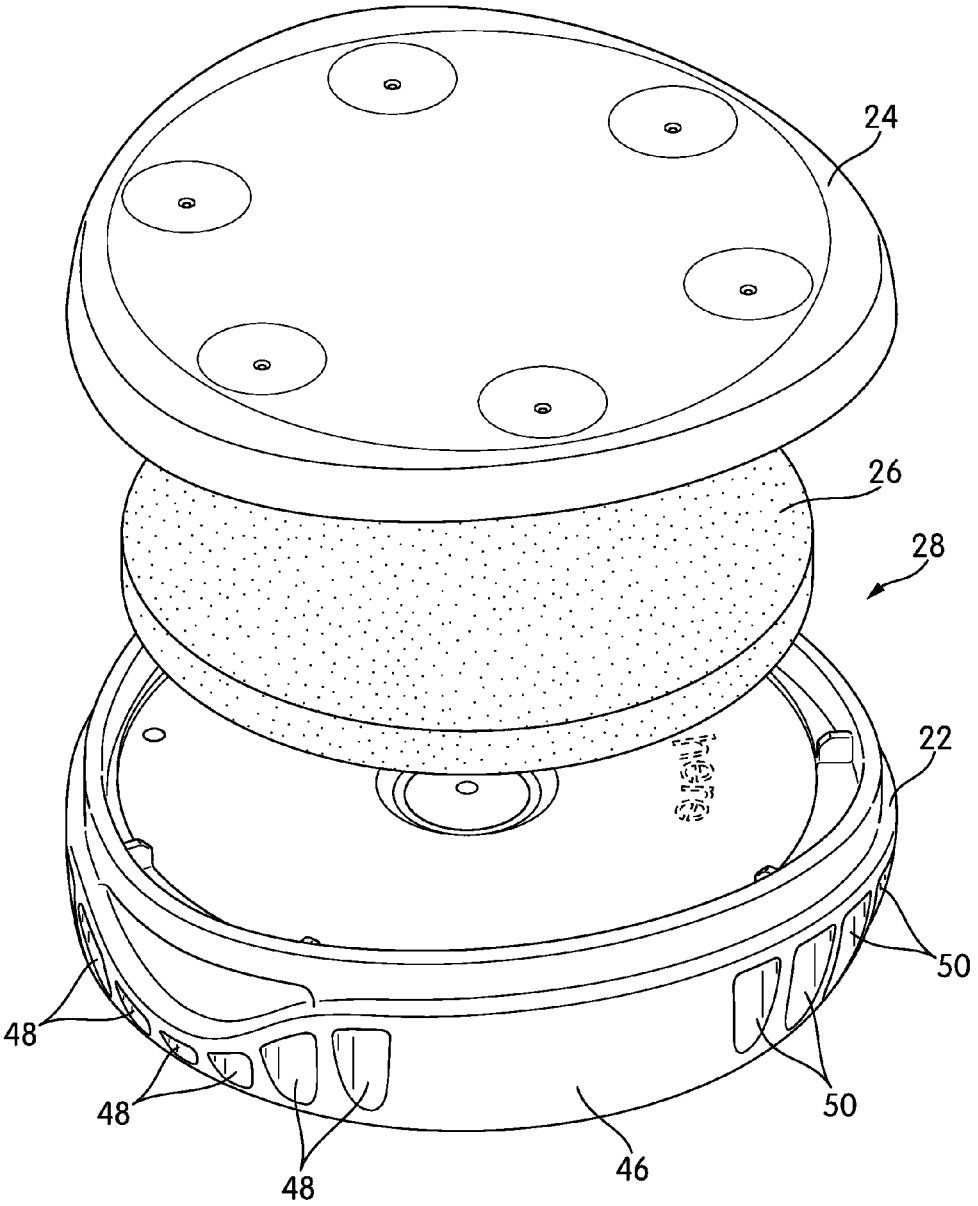
FIG. 2 is an exploded view of a closure according to an exemplary embodiment.

Referring to FIG. 2, an exploded view of an embodiment of a closure 20 is illustrated. The lower portion 22 and the upper portion 24 are configured to enclose a filter 26 in a compartment 28 formed therebetween. In one embodiment, the filter 26 is formed from porous material configured to allow gas flow therethrough while removing components from the gas causing objectionable and/or noxious odors. In one embodiment, the filter is a layer of carbon coated reticulated foam. In another embodiment, the filter is a layer of charcoal coated or treated reticulated foam. In another embodiment, the filter is a layer of charcoal coated and/or impregnated and/or impacted non-woven fibers. In another embodiment, the filter is a layer of charcoal granules. In another embodiment, the filter is a layer of activated carbon granules. In another embodiment, the filter is a layer of evaporating gel with granules, e.g., charcoal granules suspended therein. In one embodiment, the filter is formed from a slurry. In another embodiment, the filter may include biochar. In other embodiments, other suitable filters and filter materials, substrates, additives, or compositions may be used.

Figure 3:
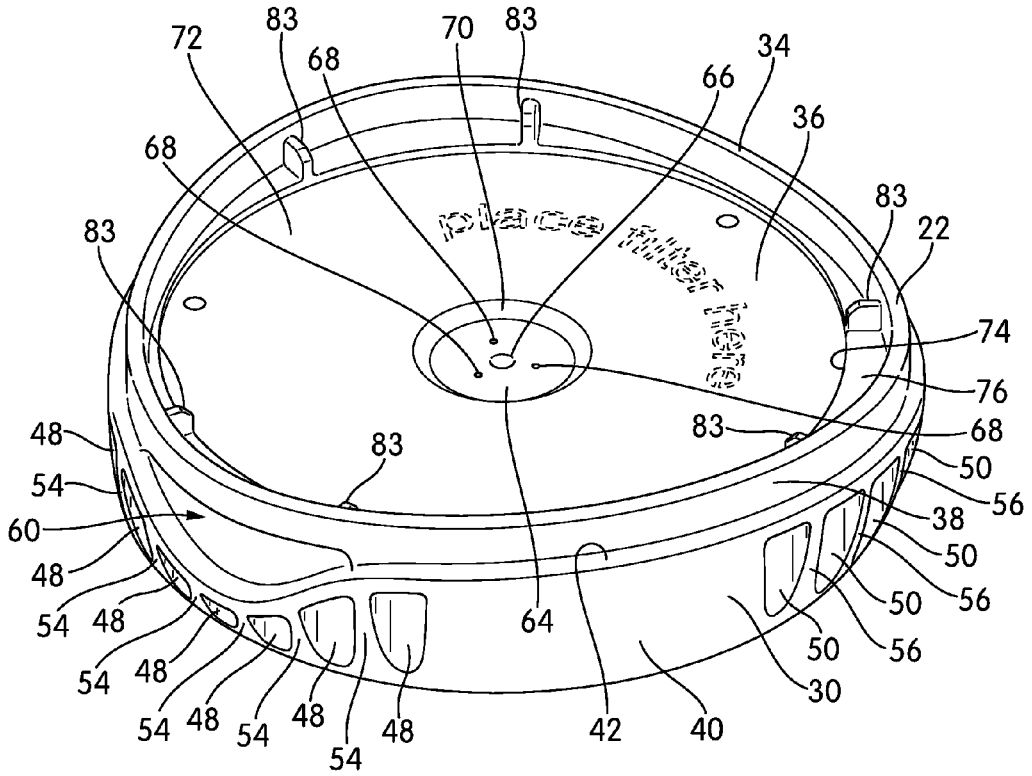
FIG. 3 is a perspective view of a lower portion of a closure according to an exemplary embodiment.
Figure 4:
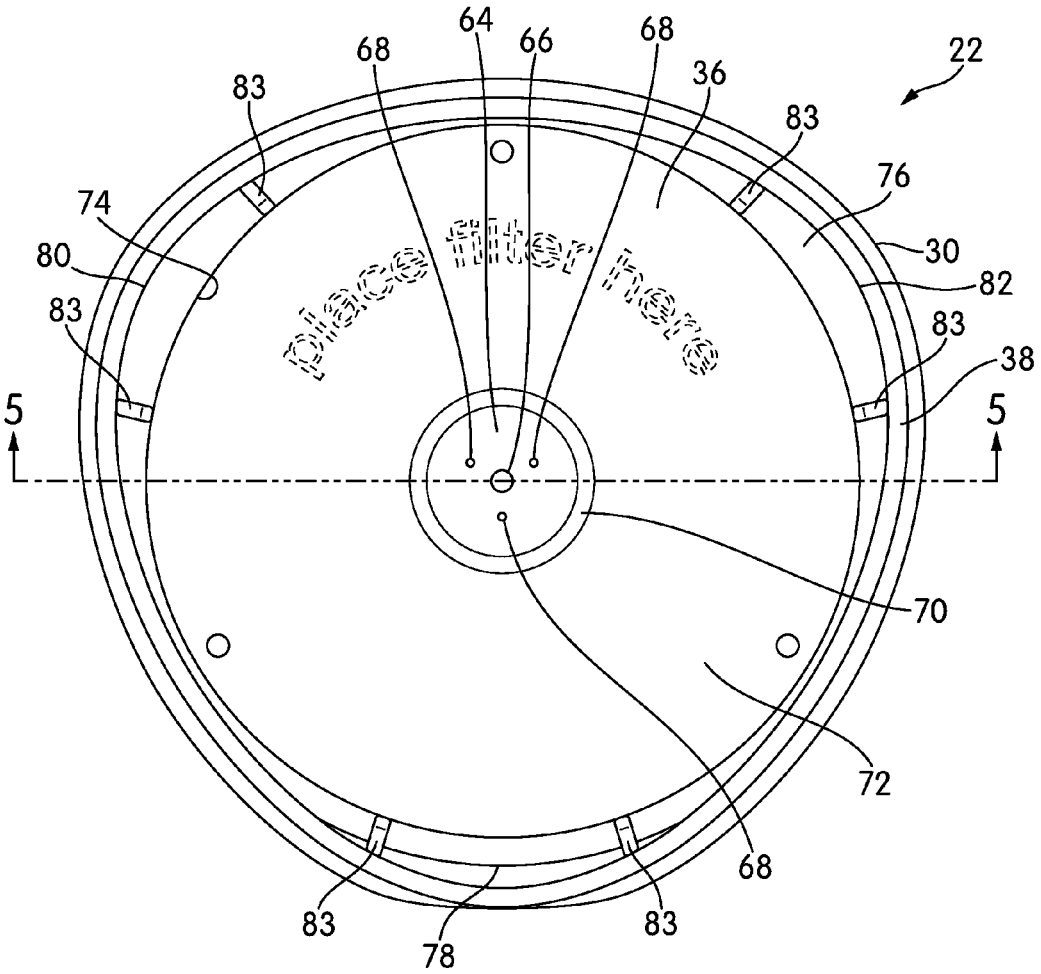
FIG. 4 is a top view of a lower portion of a closure according to an exemplary embodiment.
Figure 5:
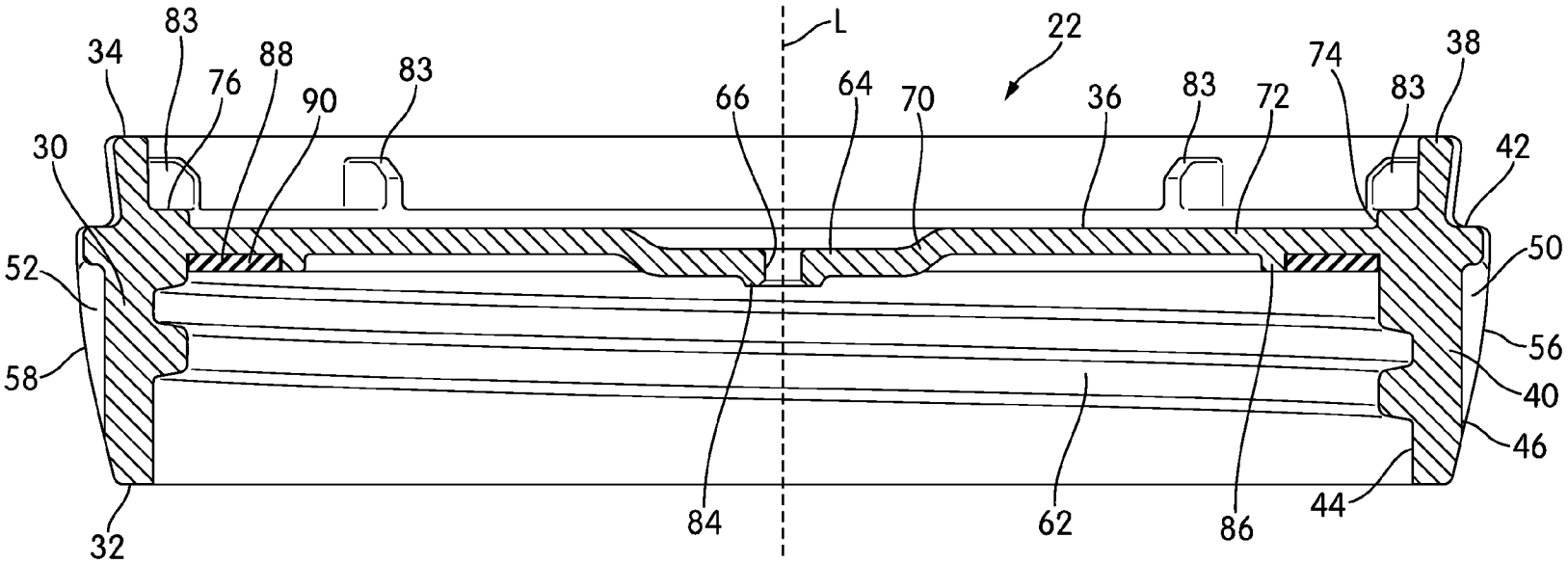
FIG. 5 is a cross-sectional view taken along the line 5-5 in FIG. 4.
Figure 6:
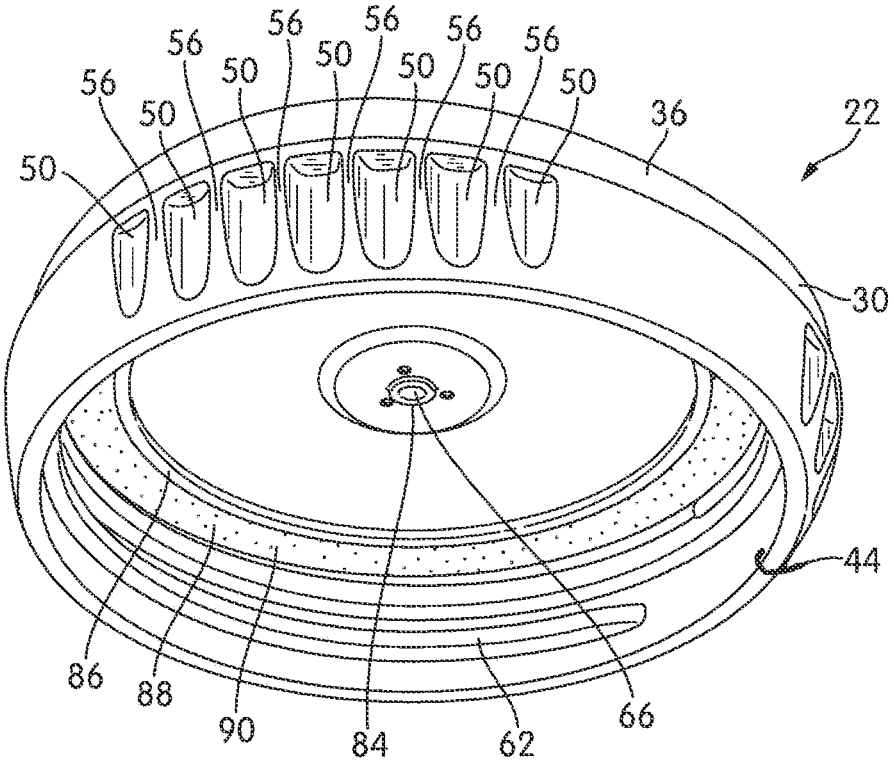
FIG. 6 is a perspective view of a lower portion of a closure according to an exemplary embodiment.
Figure 7:
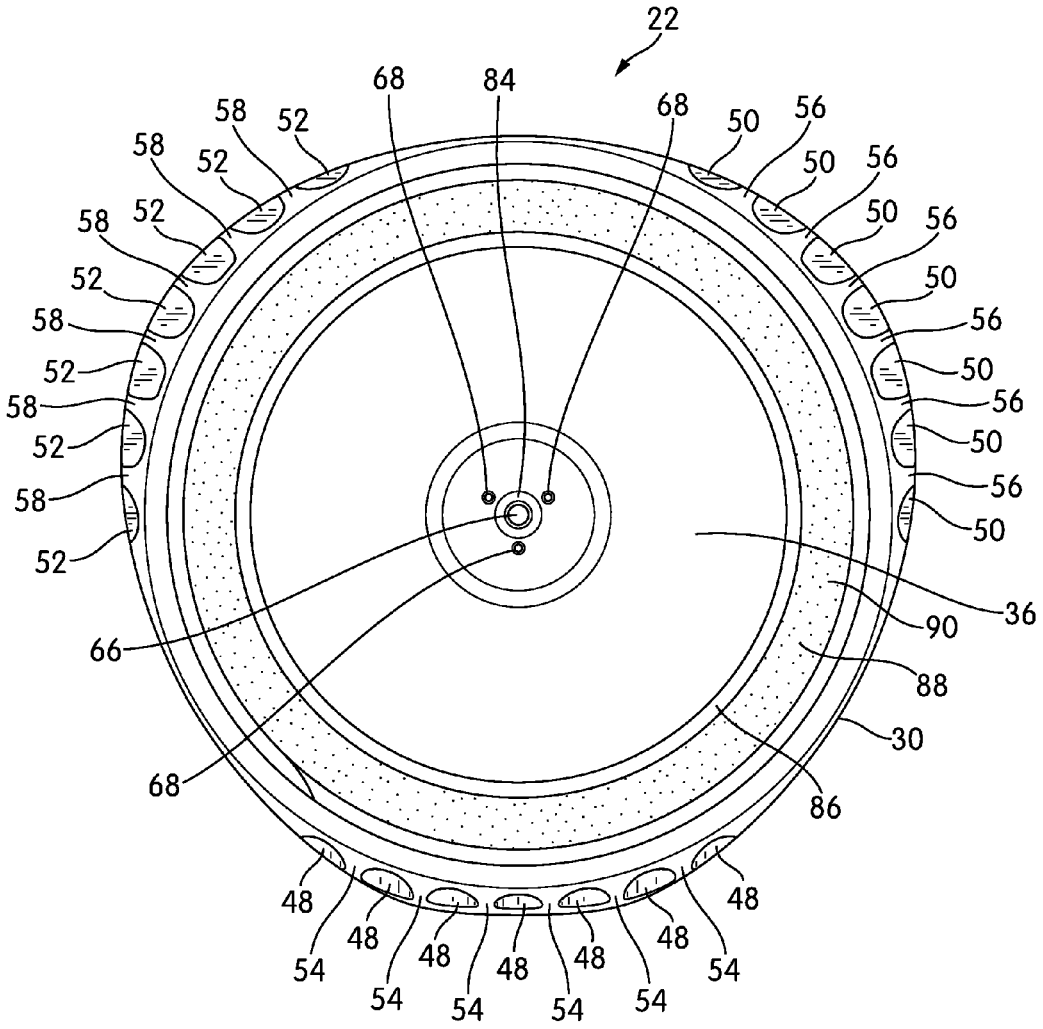
FIG. 7 is a bottom view of a lower portion of a closure according to an exemplary embodiment.
Figure 8:
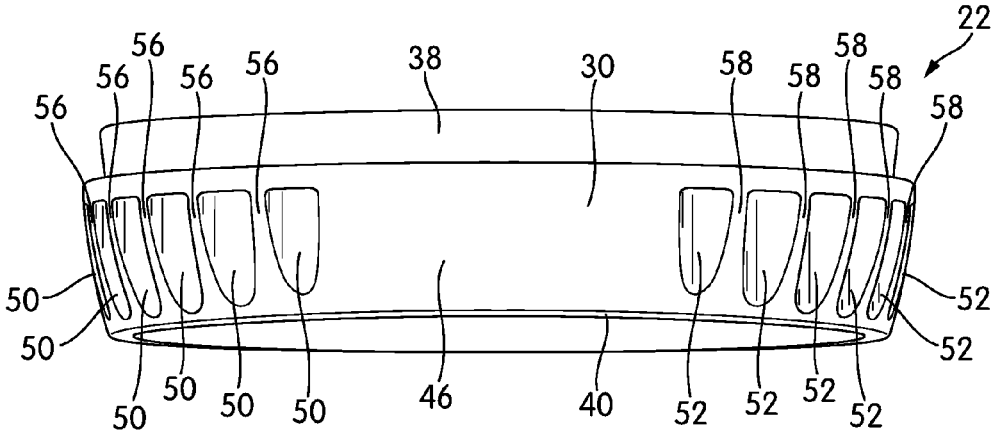
FIG. 8 is a rear view of a lower portion of a closure according to an exemplary embodiment.

With reference to FIGS. 3-8, an embodiment of a lower portion 22 of a closure 20 is illustrated. The lower portion 22 has a generally non-circular, continuously curved perimeter. The lower portion 22 includes a sidewall 30 extending along a longitudinal axis L (see FIG. 5) from a first end 32 to a second end 34. The lower portion 22 also includes an intermediate wall 36 extending from the sidewall 30 between the first end 32 and the second end 34. The sidewall 30 includes an upper portion 38 extending from the second end 34 to a lower portion 40. The lower portion 40 extends radially outwardly farther than the upper portion 38, with the radially outer axial periphery of the lower portion 40 forming a ledge 42. As illustrated in FIG. 5, the lower portion 40 includes an inner surface 44 and an outer surface 46. With reference to FIGS. 7 and 8, defined in the outer surface 46 are three groups of depressions 48, 50, and 52, the groups of depressions 48, 50, and 52 being spaced apart from one another around the perimeter of the outer surface 46 of the lower portion 40 of the sidewall 40. Formed between the depressions are ribs 54, 56, and 58. The ribs 54, 56, and 58 have outer surfaces that extend non-parallel to the longitudinal axis L, downwardly and inwardly in the direction from the second end 34 of the sidewall 30 toward the first end 32. With reference to FIG. 3, in one embodiment, the sidewall 30 has a radially inwardly depressed portion 60.

With reference to FIGS. 5 and 6, in one embodiment, the inner surface 44 of the lower portion 40 includes a coupling feature, shown in FIGS. 5 and 6 as threading 62. In another embodiment, the coupling feature may be, for example, a planar radially inwardly extending wall configured to couple, e.g., by interference fit, etc., with a container.

With further reference to FIGS. 3-5, in one embodiment, the intermediate wall 36 has an annular central portion 64 surrounding a through bore 66. Additionally, the central portion 64 defines at least one bore, shown in FIGS. 3-5 as a plurality of radially outer bores 68. Extending from the radial periphery of the central portion 64 is a transition portion 70. The transition portion 70 extends radially outwardly and axially upwardly to an outer annular portion 72. The outer annular portion 72 extends radially outwardly to a generally circular wall 74 extending axially upwardly and around the circumference of the outer annular portion 72. Extending radially outwardly from the circular wall 74 is an axially raised portion 76. The radial distance that the axially raised portion 76 extends varies around the perimeter of the lower portion 22. With reference to FIG. 4, in one embodiment, the axially raised portion 76 has a first maximum radial length at location 78, a second maximum radial length at location 80, and a third maximum radial length at location 82. In one embodiment, locations 78, 80, and 82 are each circumferentially spaced apart around the longitudinal axis L by an angular distance of approximately 120°. The raised portion 76 extends radially outwardly to the upper portion 38 of the sidewall 30.

With further reference to FIGS. 3 and 4, in one embodiment, pairs of ribs 83 extend radially inwardly from the sidewall 30 along the axially upper surface of the raised portion 76. In one embodiment, the ribs 83 in each pair are located on opposite sides of the locations 78, 80, and 82 of the radial length maximums of the raised portion 76. In one embodiment, the filter 26 (not shown in FIGS. 3-5), is configured to be located on the outer annular portion 72, with the circular wall 74 and the ribs 83 deterring the filter 26 from movement in a radial direction. In another embodiment, the lower portion 22 may be formed without ribs.

With further reference to FIGS. 5-7, in one embodiment, the lower surface of the intermediate wall 36 defines an axially downwardly extending lip 84 surrounding the through bore 66. The intermediate wall 36 also includes a radially outer downwardly extending wall 86. The downwardly extending wall 86 and the sidewall 30 define a downwardly facing channel 88 therebetween. Located in the channel 88 is a seal, shown in FIGS. 5-7 as an axial ring seal 90. The seal 90 is configured to seal with a finish of a container to prevent the contents of the container from moving radially outwardly past the seal 90. In one embodiment, the seal 90 is an overmolded rubber seal. In one embodiment, the seal 90 may be removable from the lower portion 22. In other embodiments, the seal 90 may be integrally formed with the lower portion 22. In one embodiment, the seal 90 is an elastomeric seal. In one embodiment, the seal 90 may be removable, e.g., able to be removed from the lower portion 22 and, for example, washed, and replaced into the channel 88. In one embodiment, the seal 90 is integrally formed with the lower portion 22. In another embodiment, the lower portion 22 and the seal 90 are formed by a two-shot molding process.

Figure 9:
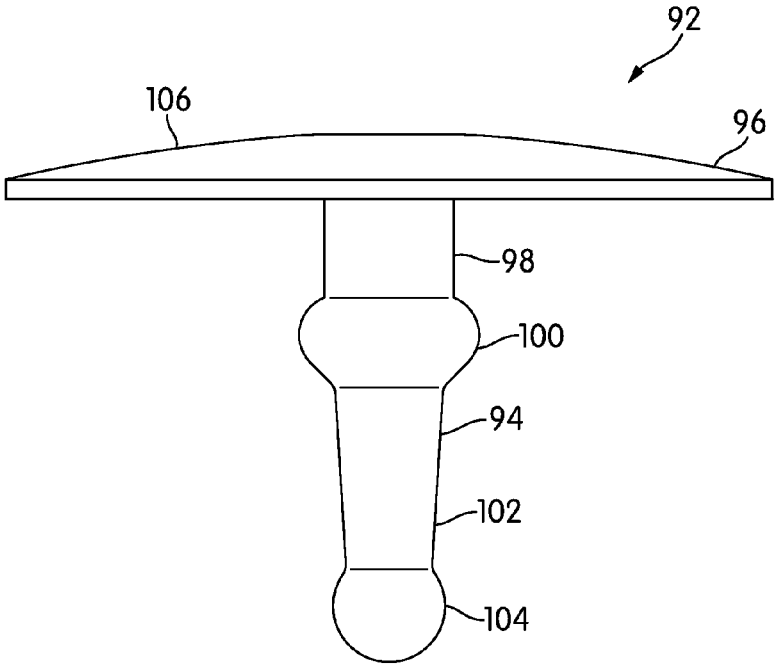
FIG. 9 is a side view of a valve according to an exemplary embodiment.

With reference to FIG. 9, an embodiment of a valve 92, e.g., an umbrella valve, is illustrated. The valve 92 has a central post portion 94 projecting axially downwardly and an upper flap portion 96 projecting radially outwardly from the central post portion 94. The post portion 94 includes an upper generally cylindrical portion 98 extending axially downwardly from the flap portion 96 to a bulbous portion 100. The bulbous portion 100 has a wider maximum radial periphery than the cylindrical portion 98. Extending axially downwardly from the axially lower periphery of the bulbous portion 100 is a tapered portion 102 extending axially downwardly and tapering radially inwardly. The tapered portion 102 extends to a rounded lower portion 104. In another embodiment, portion 102 is generally cylindrical and untapered.

Figure 10:
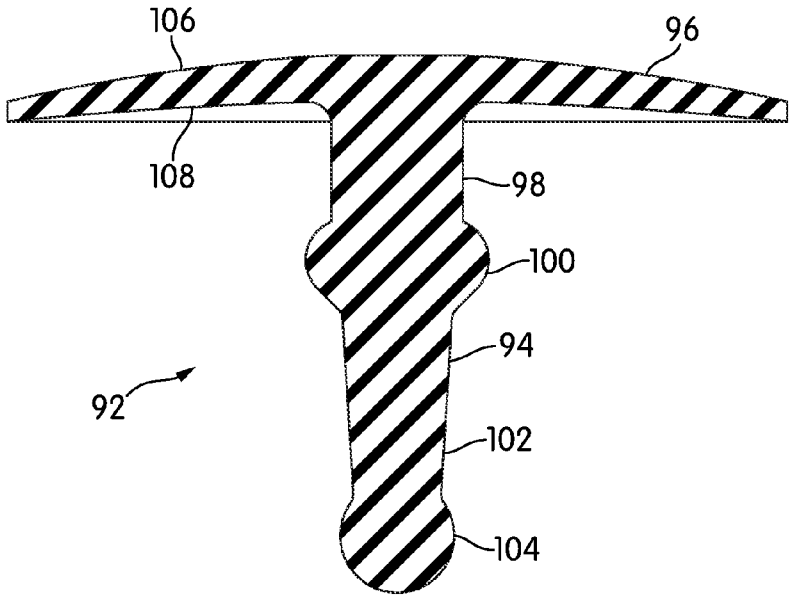
FIG. 10 is a cross-sectional view of a valve according to an exemplary embodiment.

With reference to FIGS. 9 and 10, in one embodiment, the flap portion 96 has an upper surface 106 and a lower surface 108. The upper surface 106 and the lower surface 108 each extend radially outwardly and axially downwardly. In one embodiment, the upper surface 106 slopes downwardly at a steeper angle relative to the longitudinal axis of the valve 92 than the lower surface 108.

Figure 11:
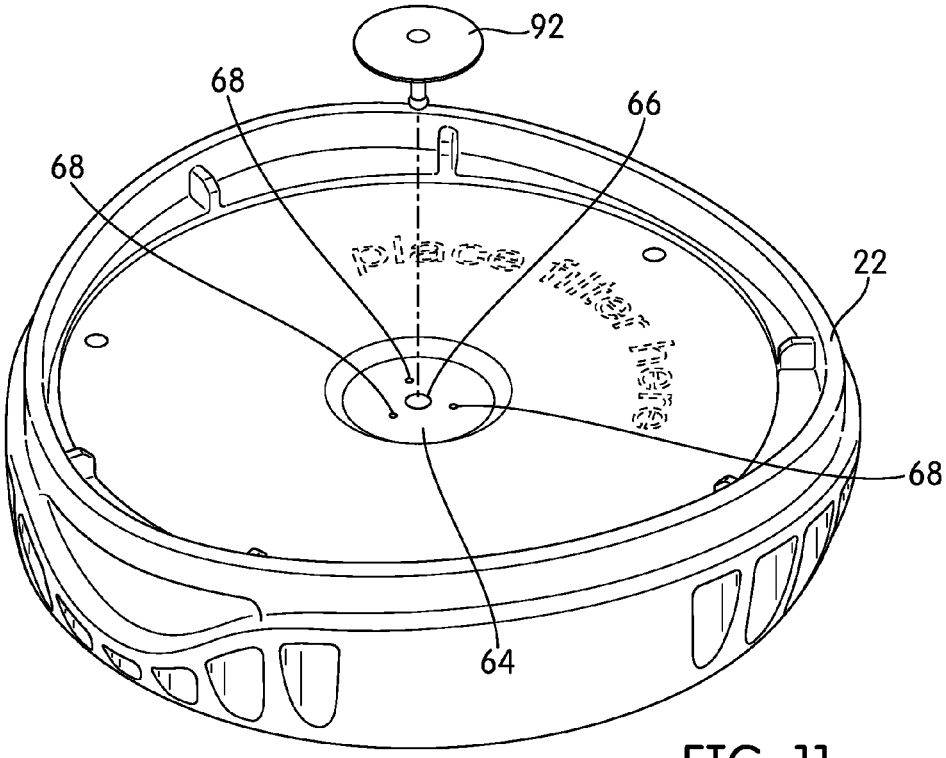
FIG. 11 is an exploded view of a valve and a lower portion of a closure according to an exemplary embodiment.
Figure 12:
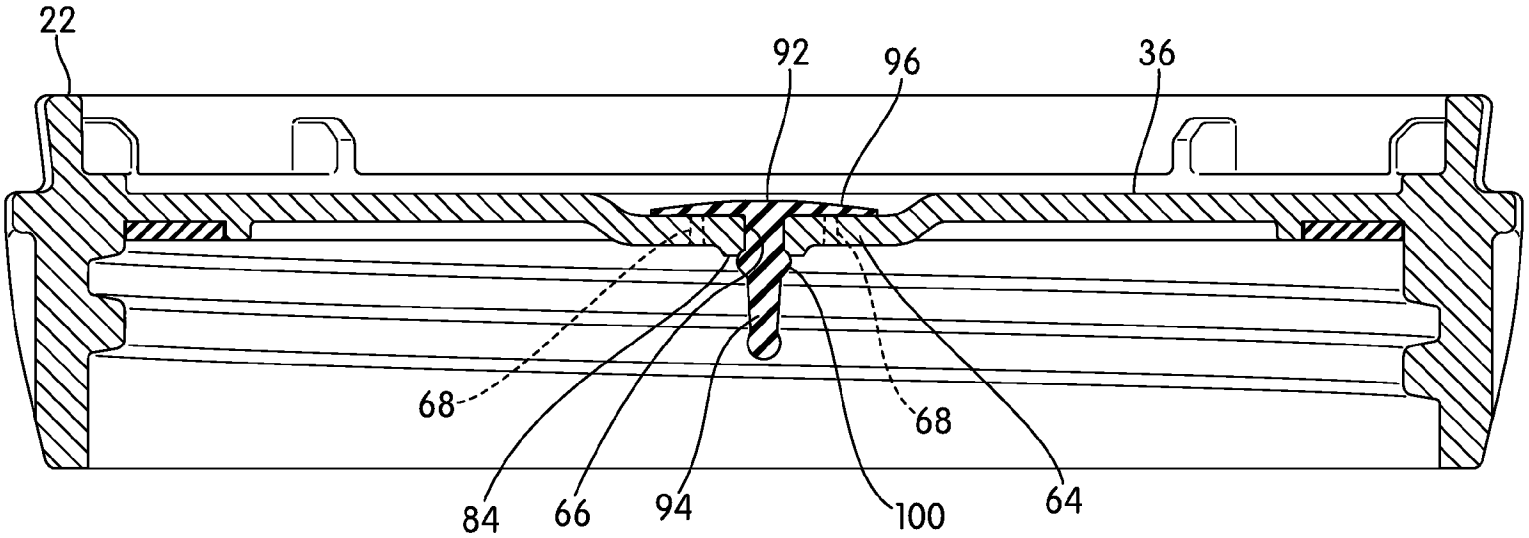
FIG. 12 is a cross-sectional view of a valve in a first configuration assembled with a lower portion of a closure according to an exemplary embodiment.
Figure 13:
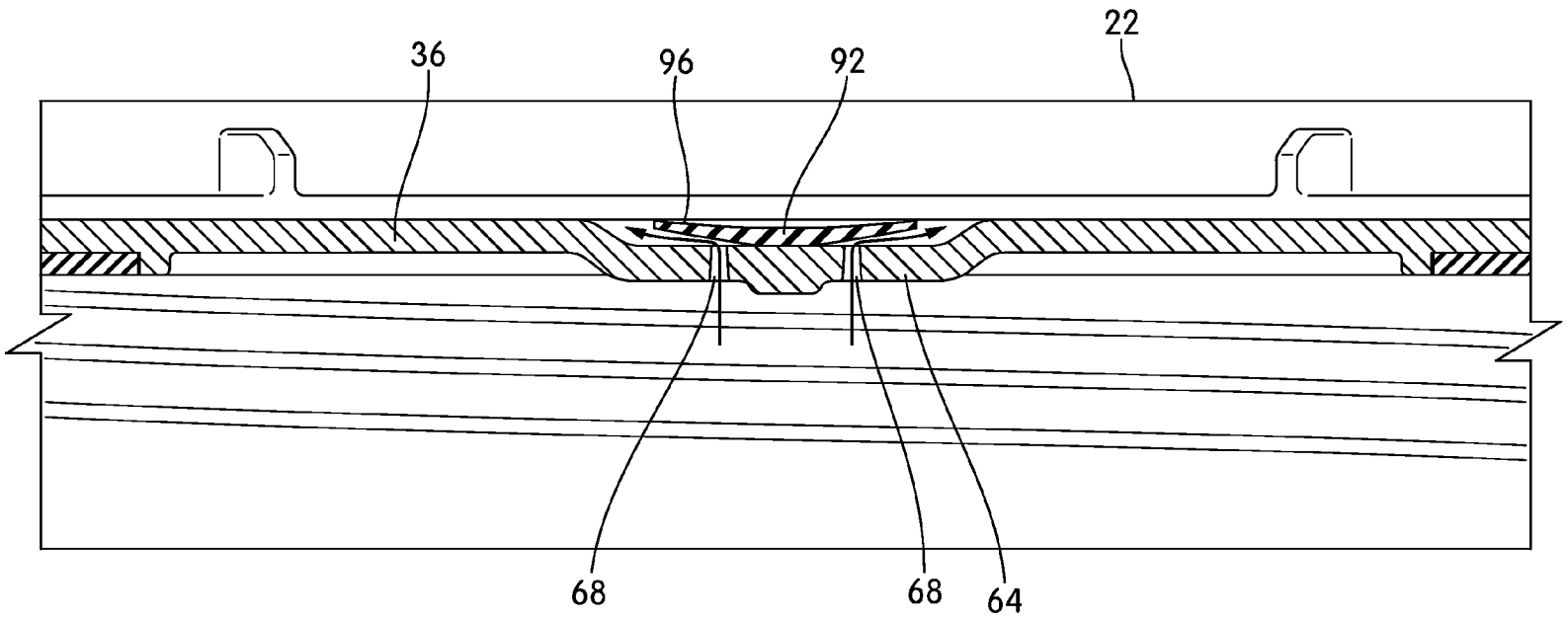
FIG. 13 is a cross-sectional view of a valve in a second configuration assembled with a lower portion of a closure according to an exemplary embodiment.
Figure 14:
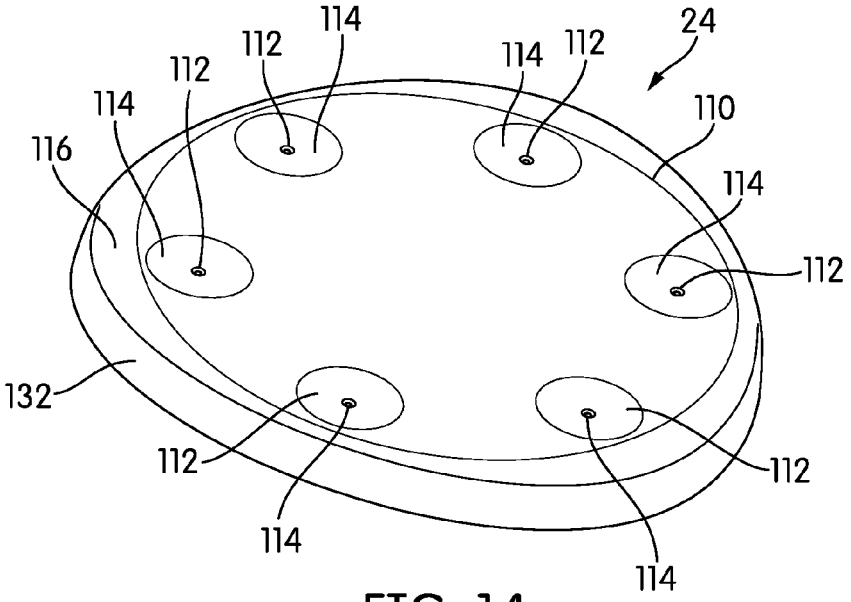
FIG. 14 is a perspective view of an upper portion of a closure according to an exemplary embodiment.

With reference to FIGS. 11-13, in one embodiment the valve 92 is configured to be received into the through bore 66 of the lower portion 22, with the flap portion 96 located on the annular central portion 64 covering the outer bores 68. The bulbous portion 100 is located below the intermediate wall 36 and has a diameter greater than the diameter of the through bore 66 deterring withdrawal of the valve 92 from the through bore 66. The flap portion 96 is biased toward a first configuration, shown in FIG. 12, in which the flap portion 96 seals with the annular central portion 64 to prevent fluid from passing into or out of a container through the outer bores 68 (not shown in FIG. 12). With reference to FIG. 13, when the pressure in a container reaches a predetermined pressure, e.g., predetermined pressure differential relative to the ambient pressure, the flap portion 96 is configured to transition into a second configuration, as shown in FIG. 13, with the radially outer portions of the flap portion 96 being raised from the annular central portion 64, allowing gas to pass outwardly from the container through the outer bores 68. The flap portion 96 is shown schematically in FIG. 13 for illustrative purposes. The flap portion 96 is biased toward and configured to return to the first configuration, shown in FIG. 12, when the pressure differential has decreased below a predetermined differential.

With reference to FIGS. 14-17, an embodiment of an upper portion 24 of the closure 20 is illustrated. The upper portion 24 includes a generally circular central wall portion 110. Circumferentially spaced apart proximate its radial periphery, the central wall portion 110 defines a plurality of bores 112 therethrough. With reference to FIG. 18, in one embodiment, the outer surface of the central wall portion 110 defines a plurality of annular depressions 114 each surround a bore 112. The depressions 114 each slope downwardly toward the bore 112 central thereto.

Figure 15:
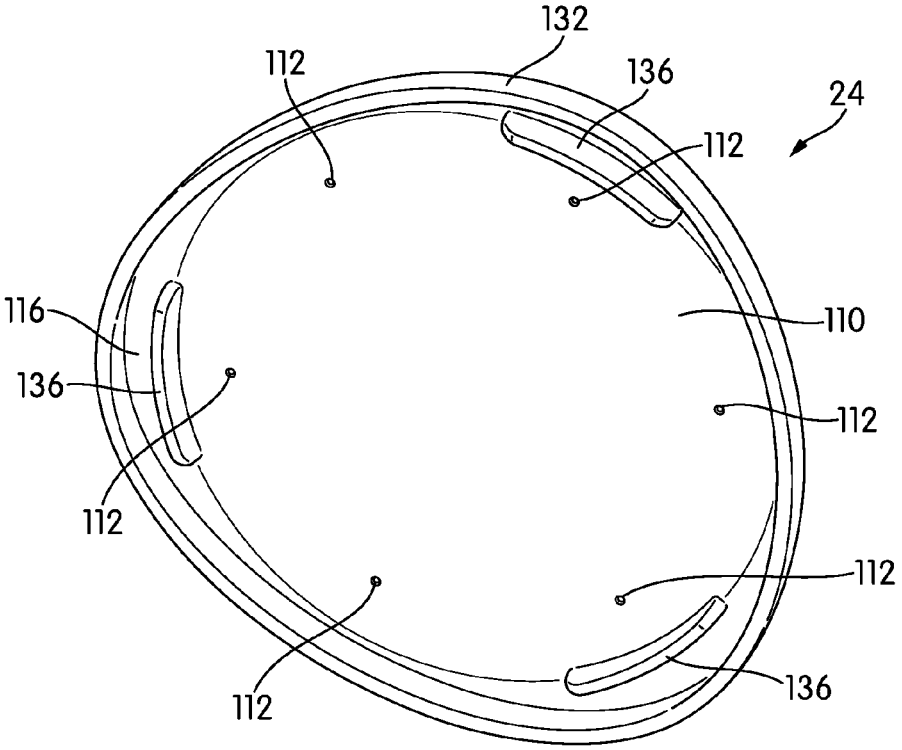
FIG. 15 is a perspective view of an upper portion of a closure according to an exemplary embodiment.
Figure 16:
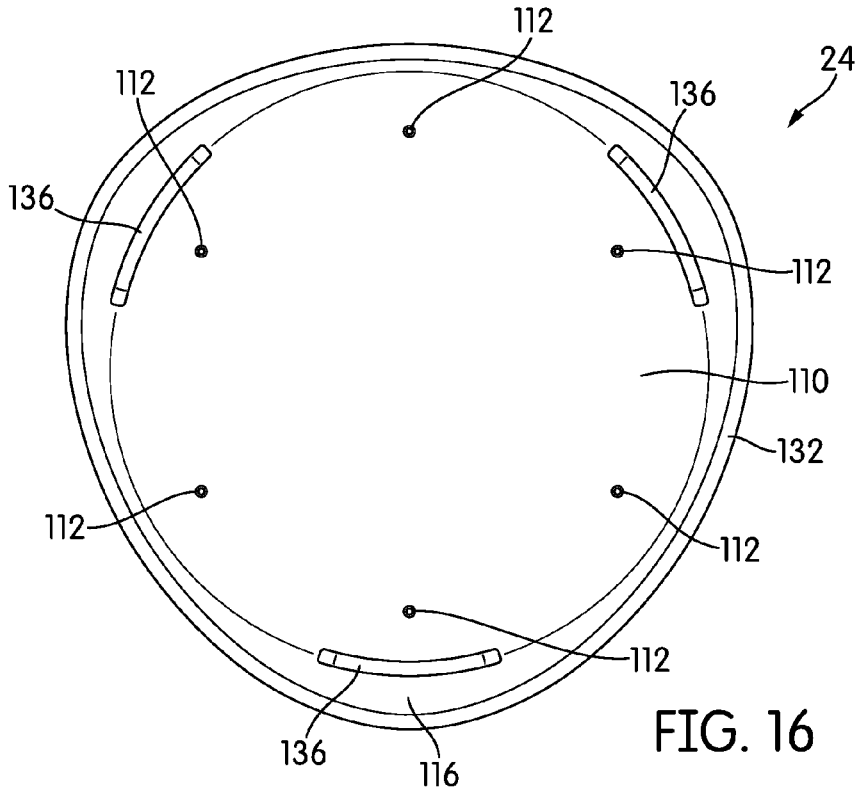
FIG. 16 is a bottom view of an upper portion of a closure according to an exemplary embodiment.
Figure 17:
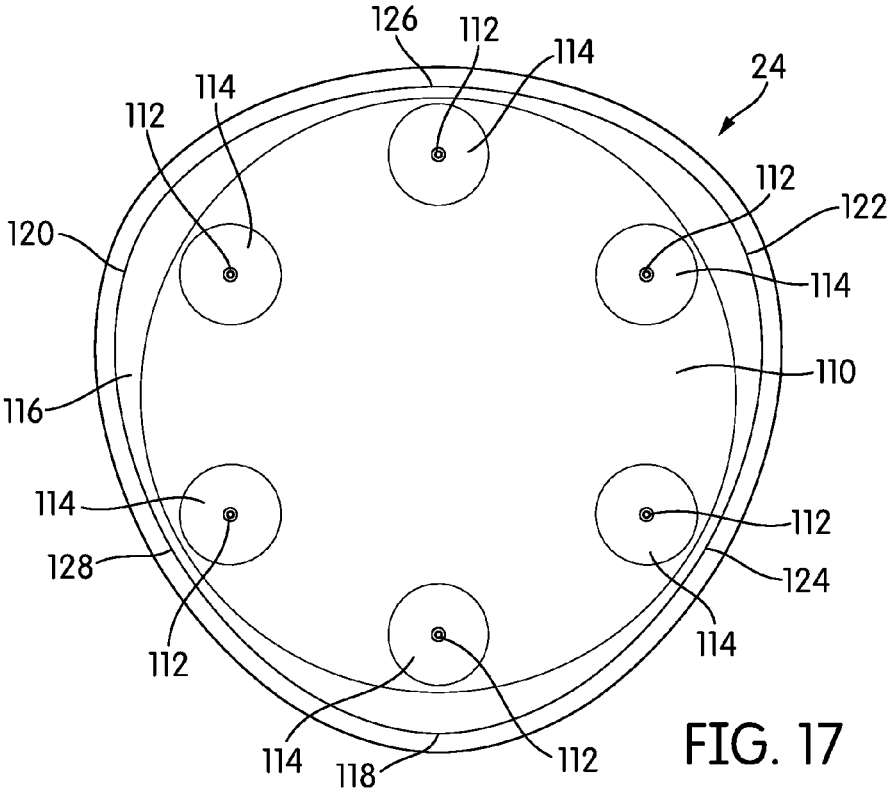
FIG. 17 is a top view of an upper portion of a closure according to an exemplary embodiment.
Figure 18:
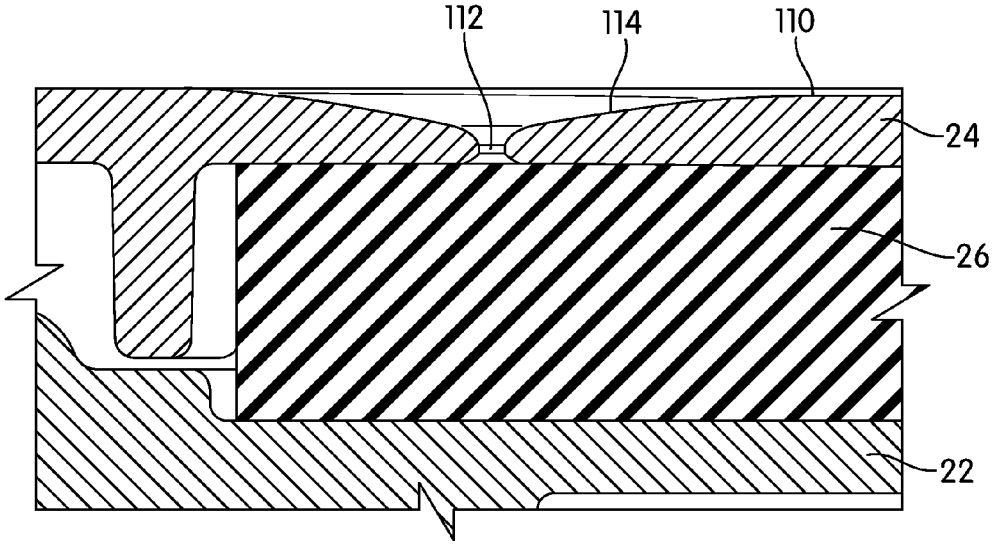
FIG. 18 is a detail view of a bore of an upper portion of a closure according to an exemplary embodiment.

With further reference to FIGS. 14-17, in one embodiment, the upper portion 24 includes a radially outwardly extending wall portion 116 extending radially outwardly from the central wall portion 110. The outwardly extending wall portion 116 extends radially outwardly from the central wall portion 110 a distance that varies around the circumference of the central wall portion 110. In one embodiment, as illustrated in FIGS. 16 and 17, the outwardly extending wall portion 116 has a maximum radial width at three locations 118, 120, and 122 spaced apart around the perimeter of the upper portion 24, each spaced apart from the others by approximately 120°. The outwardly extending wall portion 116 also has a minimum radial width at three locations 124, 126, and 128 spaced apart around the perimeter of the upper portion 24, each spaced apart from the others by approximately 120°.

Figure 19:
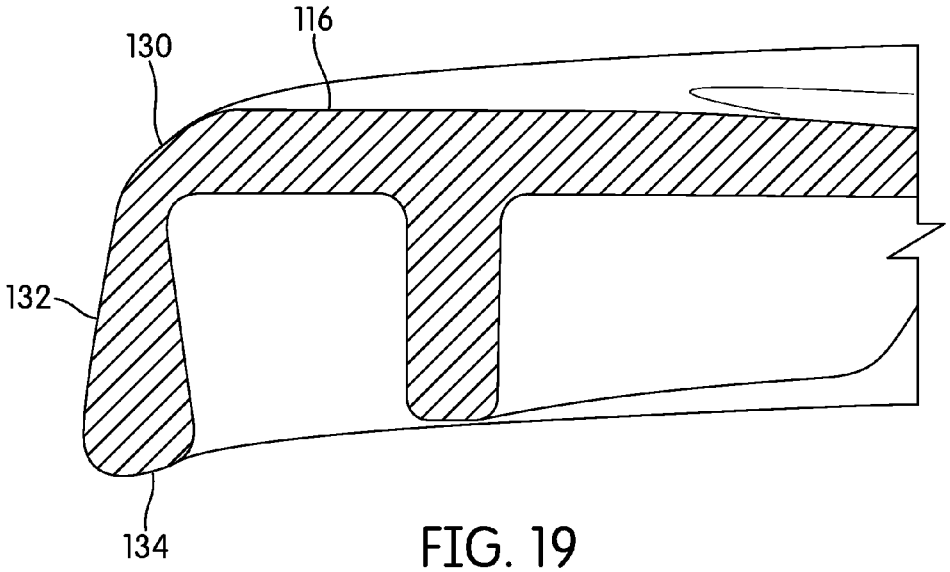
FIG. 19 is a detail view of a portion of a sidewall of an upper portion of a closure according to an exemplary embodiment.

With reference to FIG. 19, in one embodiment, a transition portion 130 extends from the radially outwardly extending wall portion 116 to a sidewall portion 132. The sidewall portion 132 extends axially downwardly to an axially lower peripheral edge 134 defining the open end of the upper portion 24. The inner surface of the sidewall portion 132 extends angularly axially downwardly and radially inwardly.

With reference to FIGS. 15 and 16, in one embodiment, the upper portion 24 includes an alignment feature, shown in FIGS. 15 and 16 as a plurality of axially downwardly extending walls 136. The walls 136 are spaced apart around the upper portion 24, each proximate one of the locations 118, 120, and 122 of the maximum radial width of the outwardly extending wall portion 114.

Figure 20:
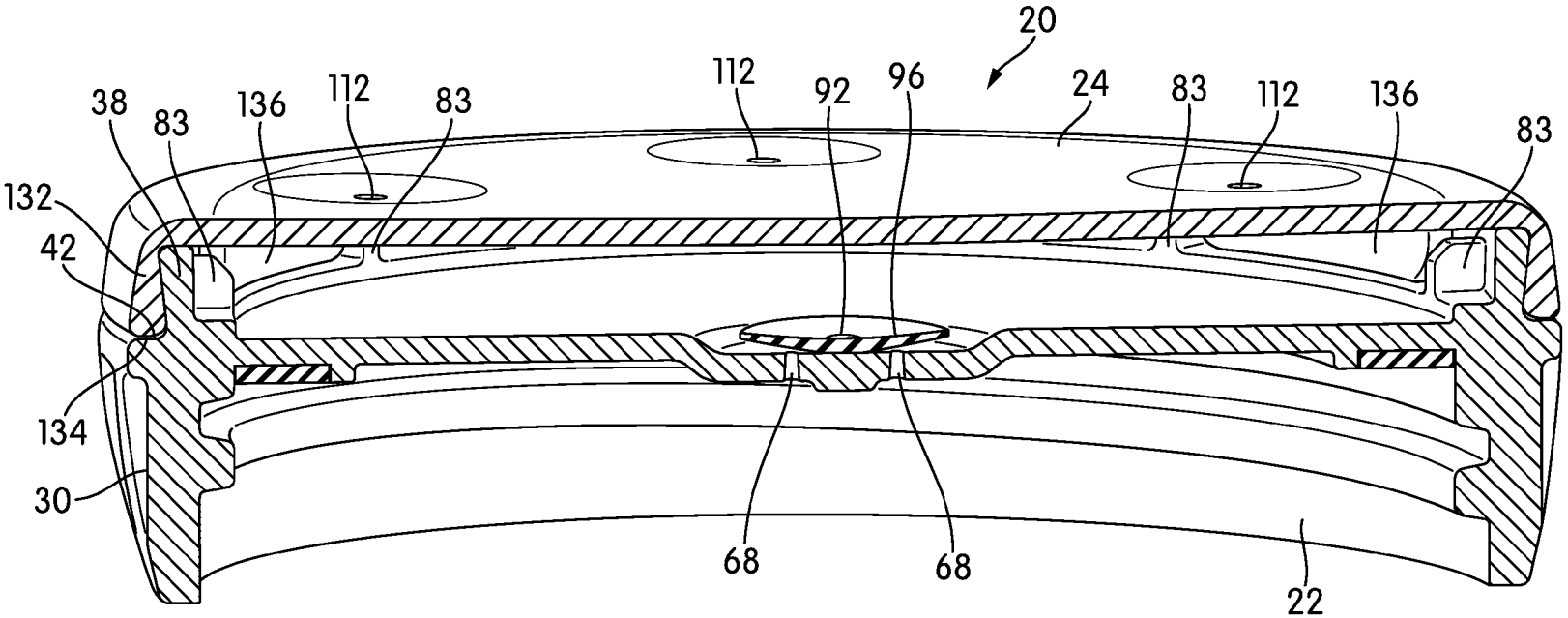
FIG. 20 is a cross-sectional view of an upper portion of a closure assembled with a lower portion of a closure according to an exemplary embodiment.

With reference to FIG. 20, a cross-sectional view of an embodiment of an assembled closure 20 with the filter 26 removed is illustrated. The axially lower peripheral edge 134 of the sidewall 132 of the upper portion 24 is located against the ledge 42 of the lower portion 22 with the sidewall 132 located radially outwardly from the upper portion 38 of the sidewall 30 of the lower portion 22. The radially outer surface of the upper portion 38 extends axially upwardly and radially outwardly and matches the shape and/or slope of the inner surface of the sidewall 132. The shape of the upper portion 38 and the sidewall 132 tend to maintain the upper portion 24 coupled to the lower portion 22. In one embodiment, the upper portion 24 is coupled to the lower portion by an interference fit. In another embodiment, the upper portion 24 is threadingly coupled to the lower portion 22. In another embodiment, other suitable coupling mechanisms may be used.

With further reference to FIG. 20, in one embodiment, the axially downwardly extending walls 136 are each sized and configured to be located between two ribs 83, allowing the upper portion 24 to be rotationally aligned with the lower portion 22 prior to the upper portion 24 and the lower portion 22 being coupled together. The ribs 83 deter rotational movement of the upper portion 24 relative to the lower portion 22 when the upper portion 24 and the lower portion 22 are engaged, preventing movement of the downwardly extending walls 136.

Figure 21:
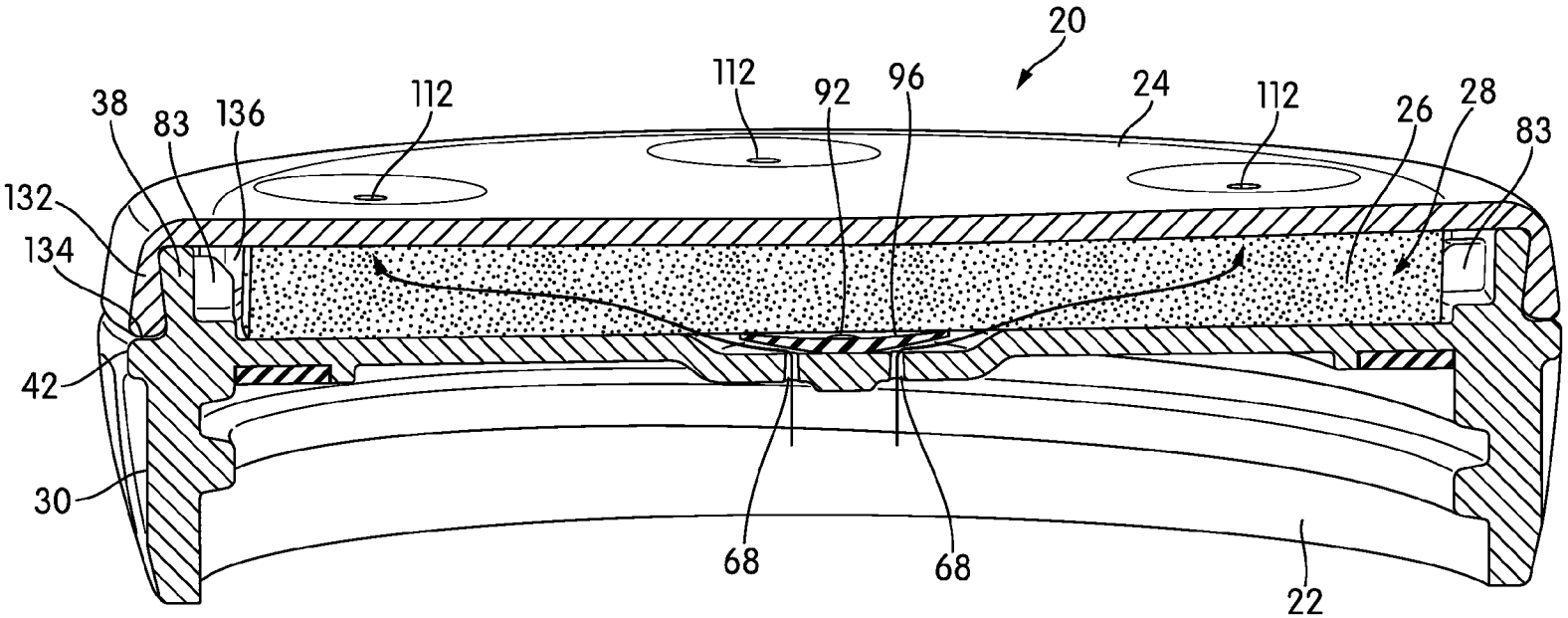
FIG. 21 is a cross-sectional view of an upper portion of a closure coupled to a lower portion of a closure showing a fluid flow path according to an exemplary embodiment.

With reference to FIG. 21, in one embodiment, when pressure inside a container to which the closure 20 is attached reaches a predetermined pressure, e.g., relative to ambient pressure, sufficient to overcome the bias force biasing the flap 96 of the valve 92 toward the first configuration, the flap 96 transitions into the second configuration, as illustrated in FIG. 21, allowing gas to flow through the outer bores 68. The bores 112 in the upper portion 24 extend along axes that are non-coaxial with axes along which the outer bores 68 extend. The bores 112 are located radially outwardly from the outer bores 68. Therefore, the gas from the bores 68 does not escape from the compartment containing the filter 26 by flowing directly axially through the filter 26, but instead also flows radially outwardly through the filter 26 to the bores 112 to exit the closure 20. The additional travel distance of the gas through the filter 26 may provide additional exposure of the gas to the filter material 26 and may provide additional filtering of objectionably and/or noxious odor causing components from the gas when compared to gas only travelling axially through the filter 26.

Figure 22:
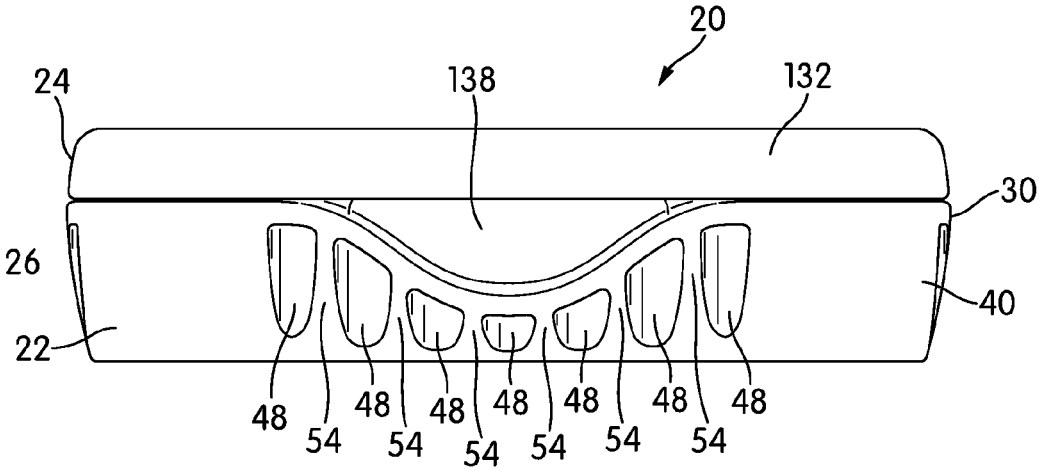
FIG. 22 is a front view of an embodiment of a closure according to an exemplary embodiment.
Figure 23:
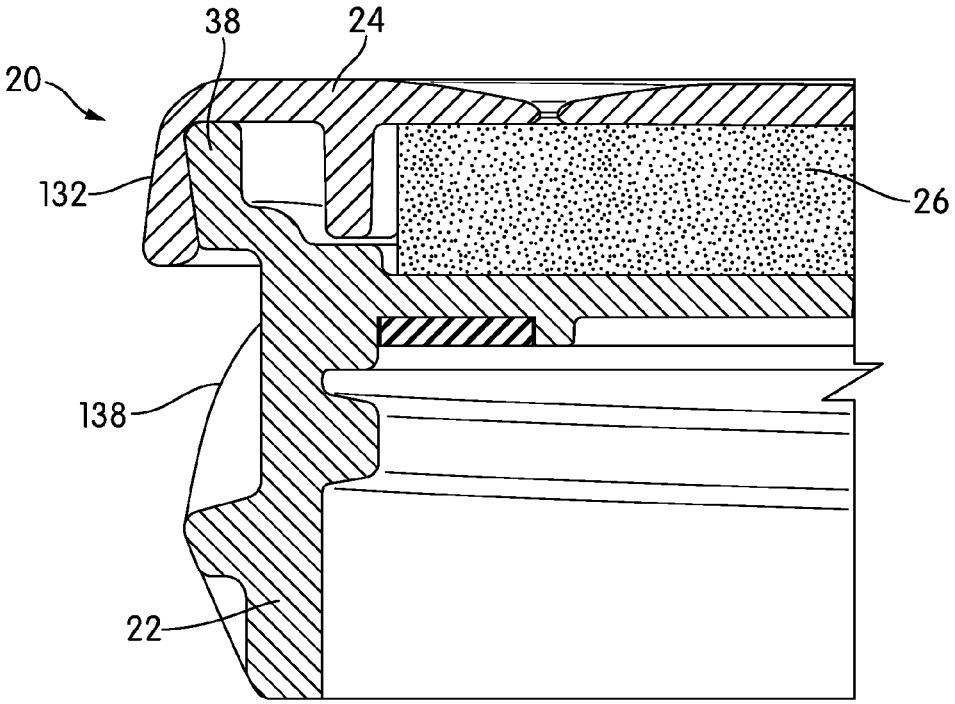
FIG. 23 is a detail cross-sectional view of an upper portion of a closure coupled to a lower portion of a closure according to an exemplary embodiment.

With reference to FIGS. 22 and 23, in one embodiment, the outer surface of the lower portion 40 of the sidewall 30 defines a recessed finger space 138 configured to allow a user access to the lower axial periphery of the sidewall 132 to remove the upper portion 24 from the lower portion 22, allowing replacement of the filter 26. The profile and/or shape of the closure 20 may provide for enhanced ease, rotational leverage, etc., to allow for coupling and removing the closure 20 from a container. In another embodiment, a tab may be provided projecting radially outwardly and configured to allow a user to remove the upper portion 24 from the lower portion 22, allowing replacement of the filter 26.

Figure 24:
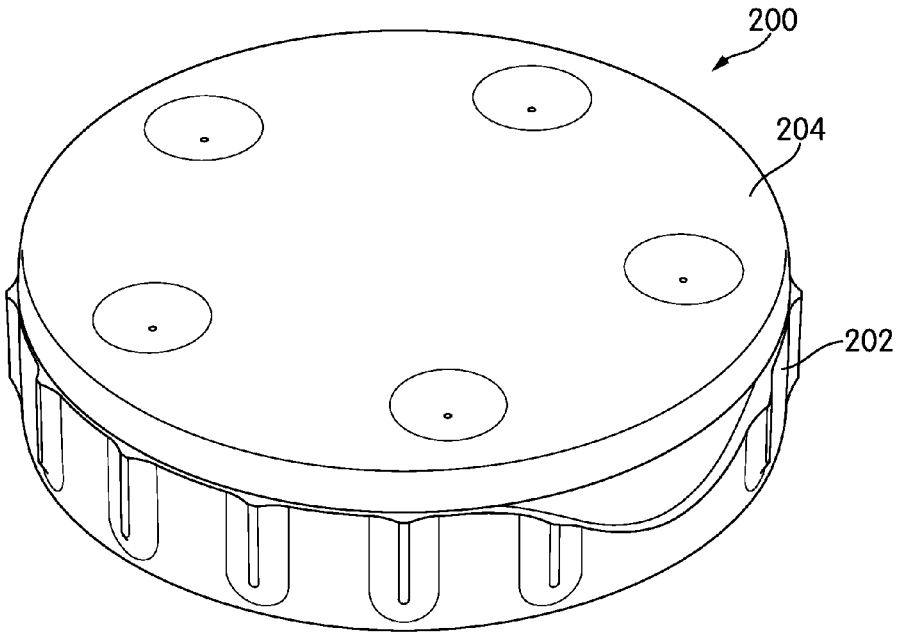
FIG. 24 is a perspective view of a closure according to an exemplary embodiment.
Figure 25:
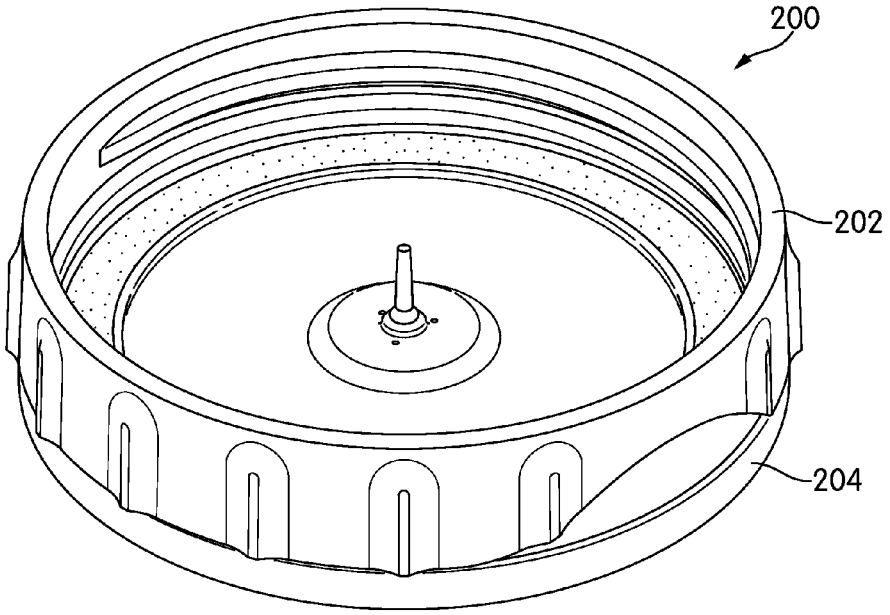
FIG. 25 is a perspective view of a closure according to an exemplary embodiment.

With reference to FIGS. 24 and 25, another embodiment of a closure 200 is illustrated. The closure 200 has many features similar to features of the closure 20, therefore, differences from the closure 20 are the focus of the description below.

Figure 26:
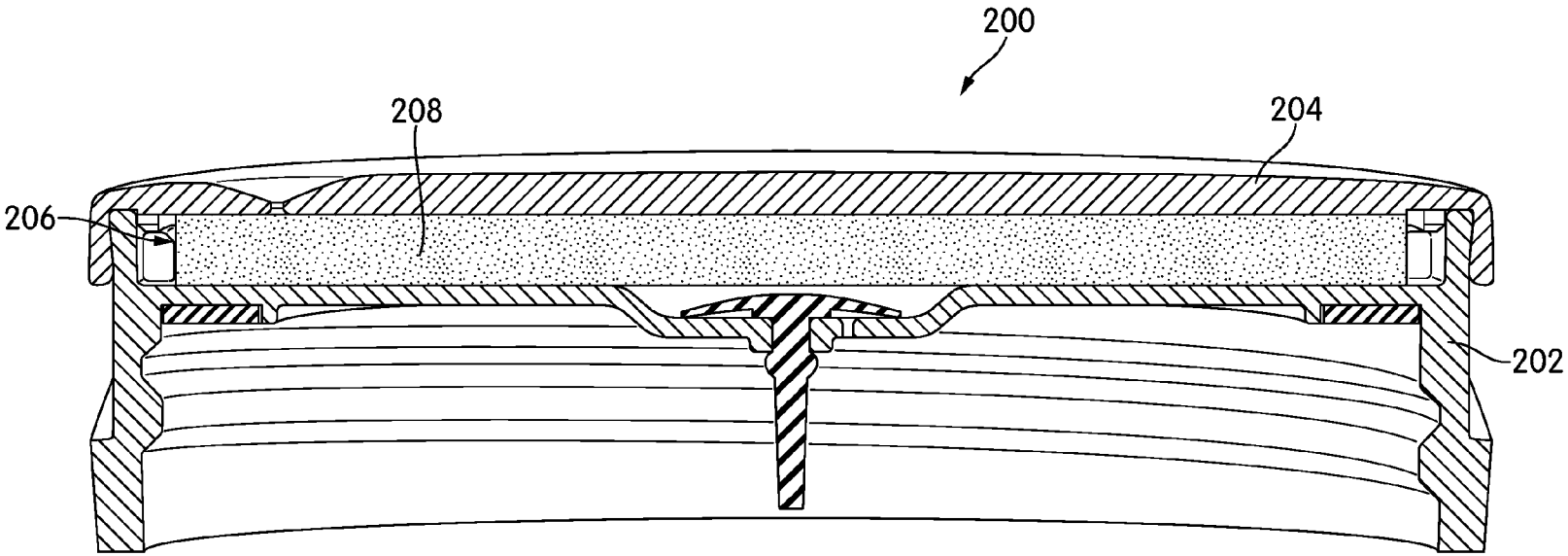
FIG. 26 is a cross-sectional view of a closure according to an exemplary embodiment.
Figure 27:
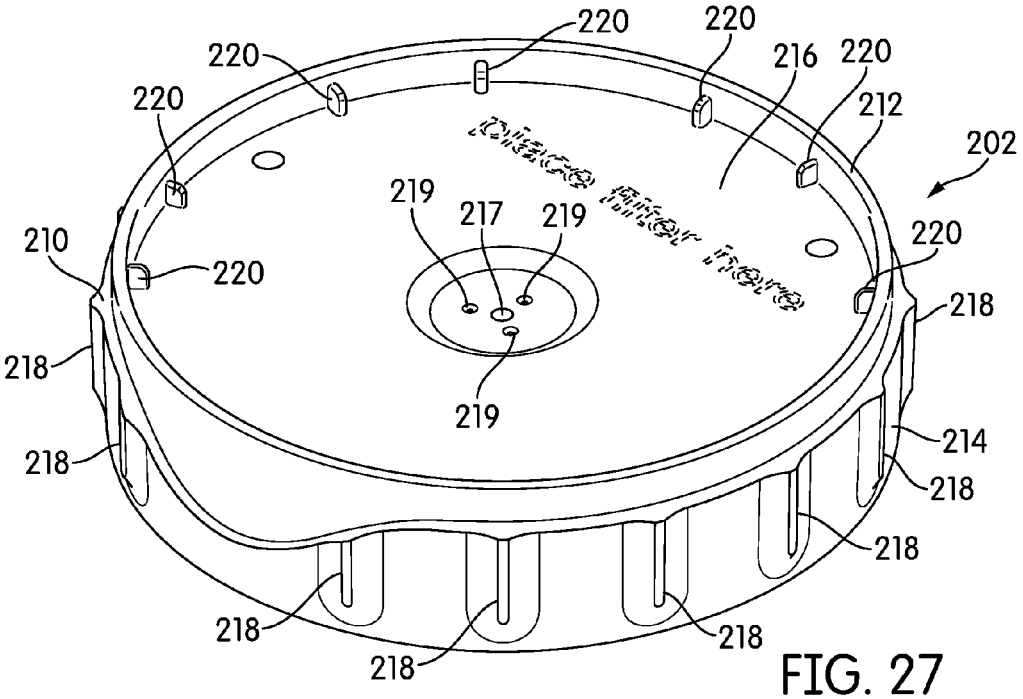
FIG. 27 is a perspective view of a lower portion of a closure according to an exemplary embodiment.
Figure 28:
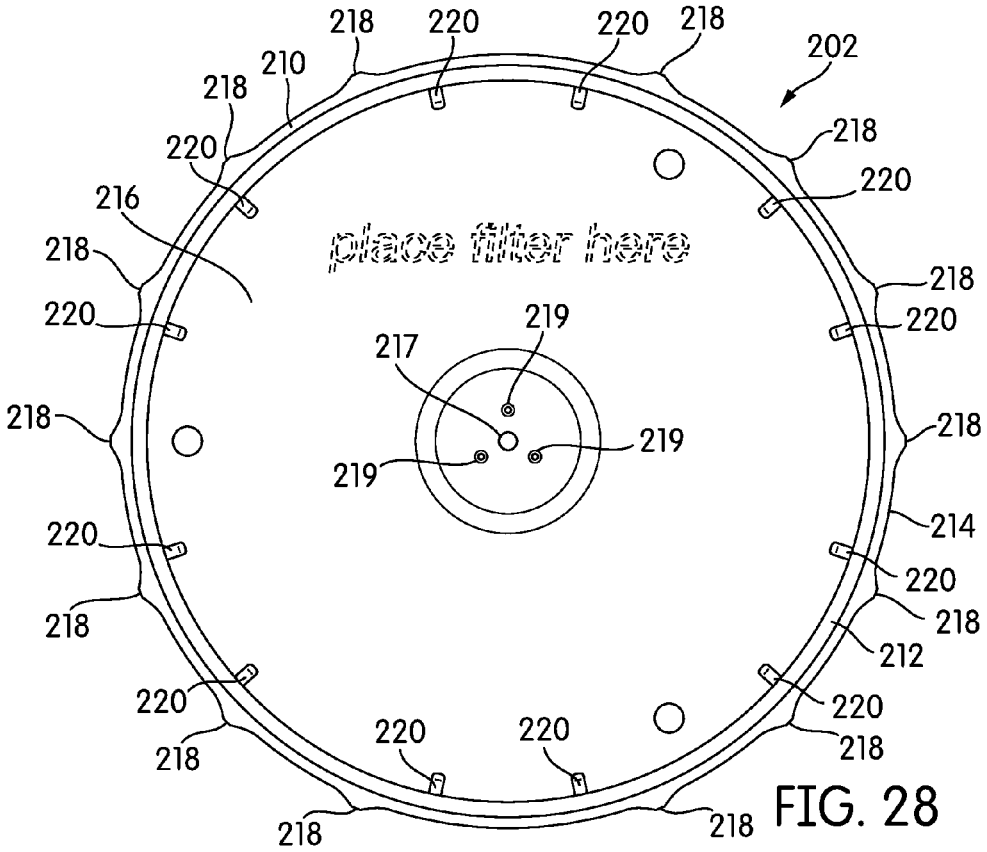
FIG. 28 is a top view of a lower portion of a closure according to an exemplary embodiment.

In one embodiment, the closure 200 has a lower portion 202 and an upper portion 204. As illustrated in FIG. 26, the lower portion 202 and the upper portion 204 define a compartment 206 therebetween in which a filter 208 is located. With reference to FIGS. 27 and 28, the lower portion 202 has a generally circular shape and includes a sidewall 210 including an upper portion 212 and a lower portion 214. The lower portion 214 extends radially outwardly farther than the upper portion 212. The outer surface of the lower portion 214 defines a plurality of generally vertical radially outwardly extending ribs 218 spaced apart around the circumference of the lower portion 214. Extending radially inwardly from the sidewall 210 is an intermediate wall 216 on which the filter 208 (not shown in FIGS. 27 and 28) is located. Extending radially inwardly from the upper portion 212 are a plurality of locating ribs 220 spaced apart around the circumference of the intermediate wall 216. The intermediate wall 216 has a central through bore 217 configured to receive a valve and three outer bores 219 located radially outwardly from the central through bore 217. While three outer bores 219 are shown in the illustrated embodiment, in other embodiments, other suitable numbers of bores may be provided.

Figure 29:
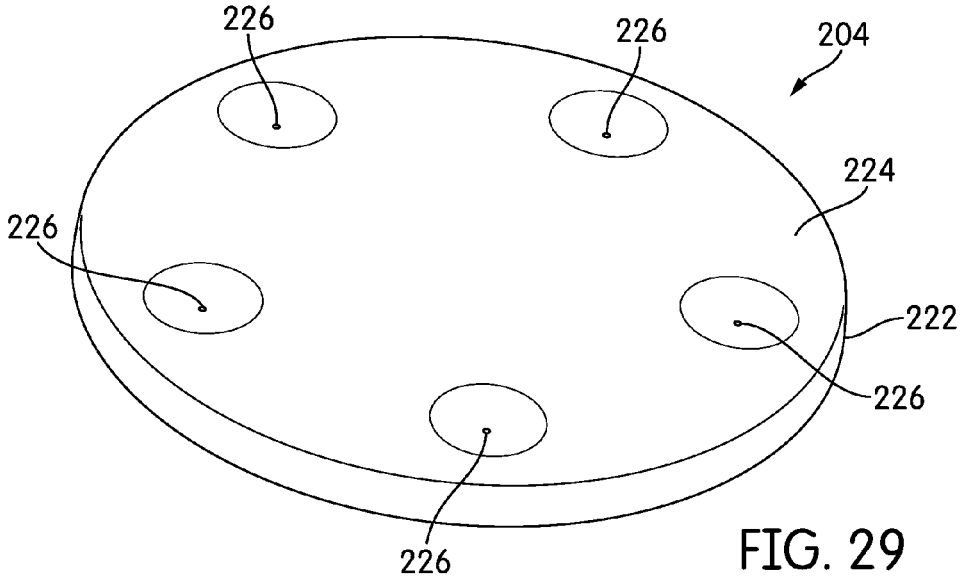
FIG. 29 is a perspective view of an upper portion of a closure according to an exemplary embodiment.
Figure 30:
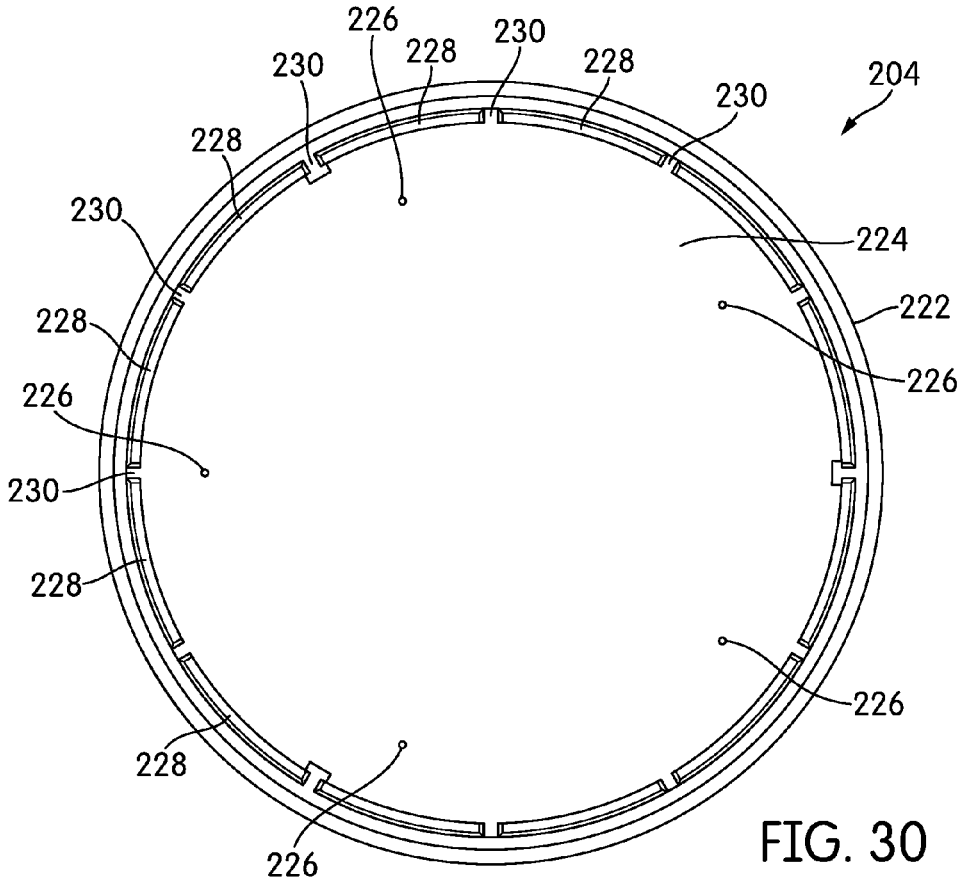
FIG. 30 is a bottom view of an upper portion of a closure according to an exemplary embodiment.
Figure 31:
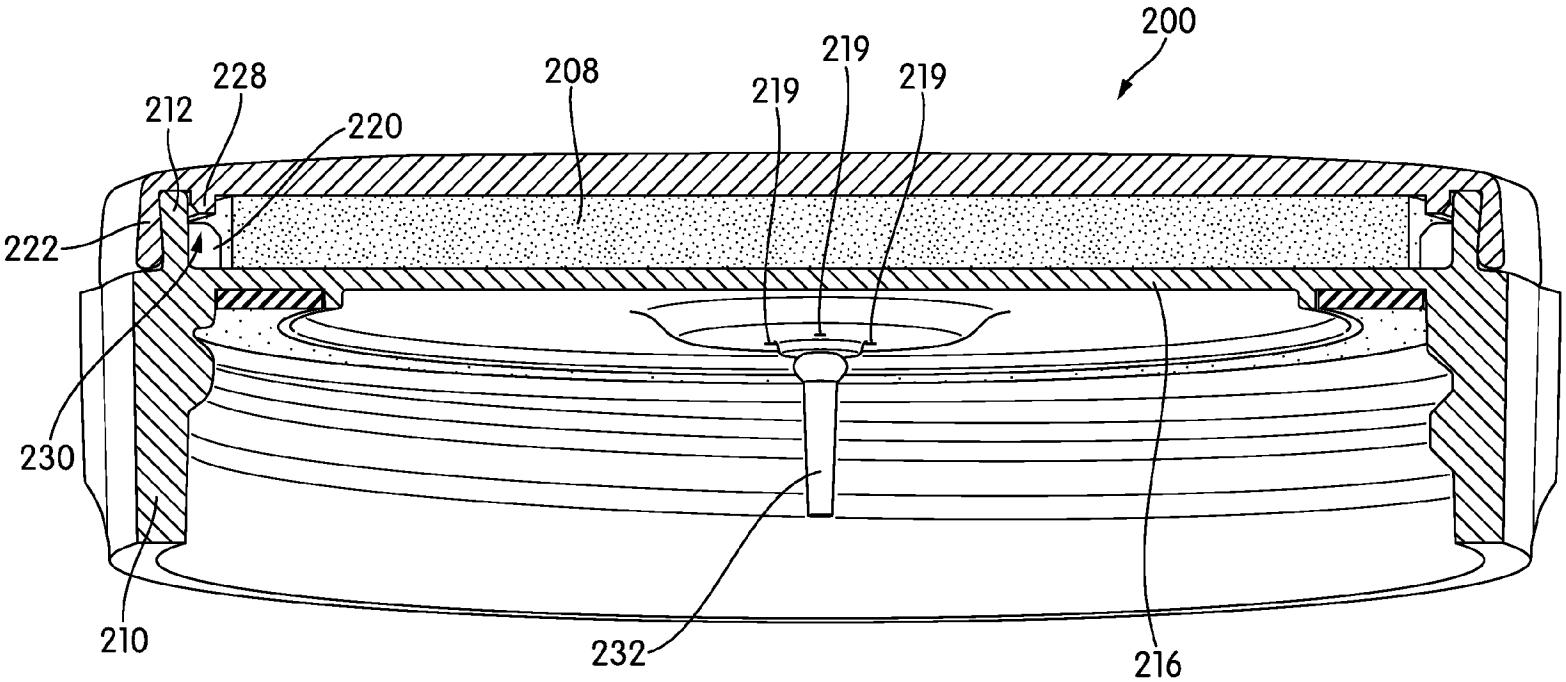
FIG. 31 is a cross-sectional view of a closure according to an exemplary embodiment.

With reference to FIGS. 29 and 30, in one embodiment, the upper portion 204 has a generally circular radial periphery. The upper portion 204 includes a generally cylindrical sidewall 222 extending along a longitudinal axis and an end wall 224 closing one end of the sidewall 222. The end wall 224 has bores 226 extending therethrough. As in the previous embodiment, the bores 226 are located radially outwardly relative to bores 219 in the lower portion 202. As illustrated in FIG. 30, the upper portion 204 includes a plurality of locating walls 228 spaced apart around the circumference of and extending axially downwardly from the end wall 224. The walls 228 define between them locating rib receiving spaces 230. As shown in FIG. 31, the walls 228 and the ribs 220 provide for orientation and/or keying features configured to orient the upper portion 204 relative to the lower portion 202 before the upper portion 204 can be coupled to the lower portion 202. With the ribs 220 located in the spaces 230 between the walls 228, rotational movement of the upper portion 204 relative to the lower portion 202 is deterred.

With reference to FIG. 31, as in the previous embodiment, the closure 200 includes a valve 232 biased toward a first configuration in which the valve 232 prevents fluid flow through outer bores 219 in the intermediate wall 216. As in the previous embodiment, when the pressure in a container to which the closure 200 is coupled reaches a predetermined pressure sufficient to overcome the force biasing the valve 232 to the first closed configuration, the valve 232 transitions to a second open configuration allowing fluid flow through the outer bores 219 through the intermediate wall 216 to the filter 208. The bores through the intermediate wall 216 are located radially inwardly from the bores 226 in the upper portion 204 such that fluid flows both radially and axially through the filter 208 to escape from the closure 200.

Figure 32:
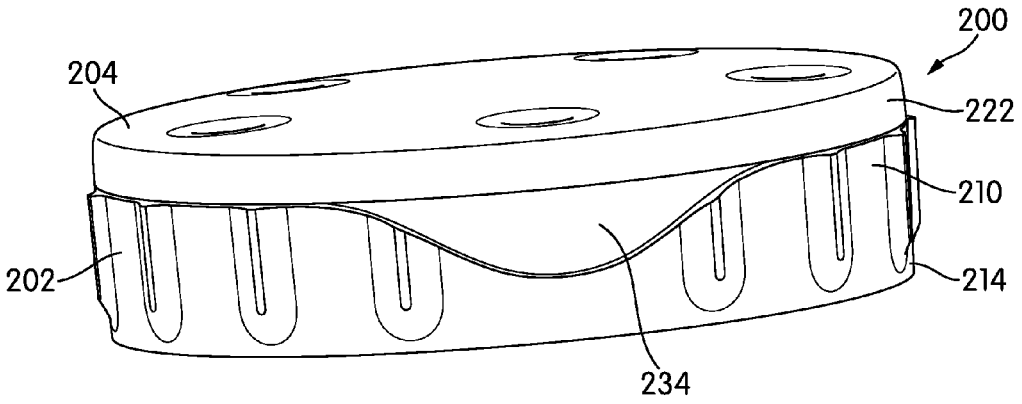
FIG. 32 is a side view of a closure according to an exemplary embodiment.
Figure 33:
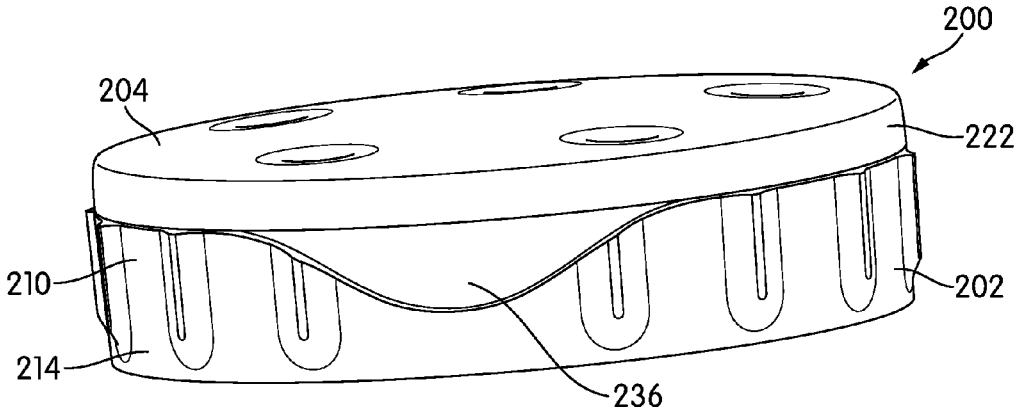
FIG. 33 is a view of a side opposite the side shown in FIG. 32 of a closure according to an exemplary embodiment.
Figure 34:
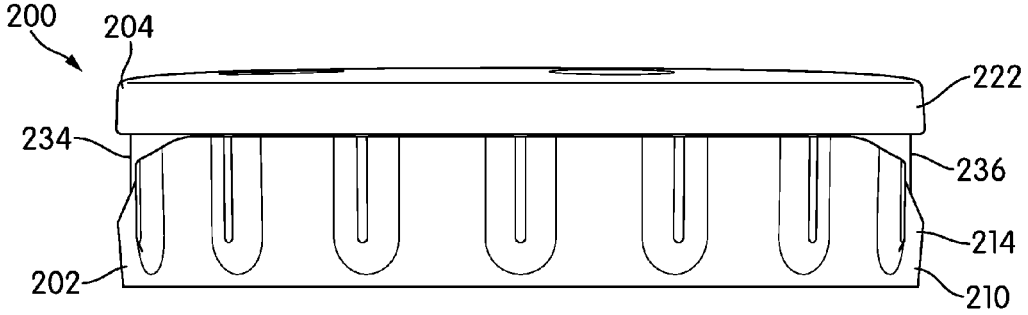
FIG. 34 is a front view of a closure according to an exemplary embodiment.

With reference to FIGS. 32-34, in one embodiment, the outer surface of the lower portion 214 of the sidewall 210 defines a first recessed finger space 234 and a second recessed finger space 236 on the opposite side, e.g., separated by approximately 180°, from the first recessed finger space 234. The finger spaces 234 and 236 are configured to allow a user access to the lower axial periphery of the sidewall 222 to remove the upper portion 204 from the lower portion 202, allowing replacement of the filter 208.

Figure 35:
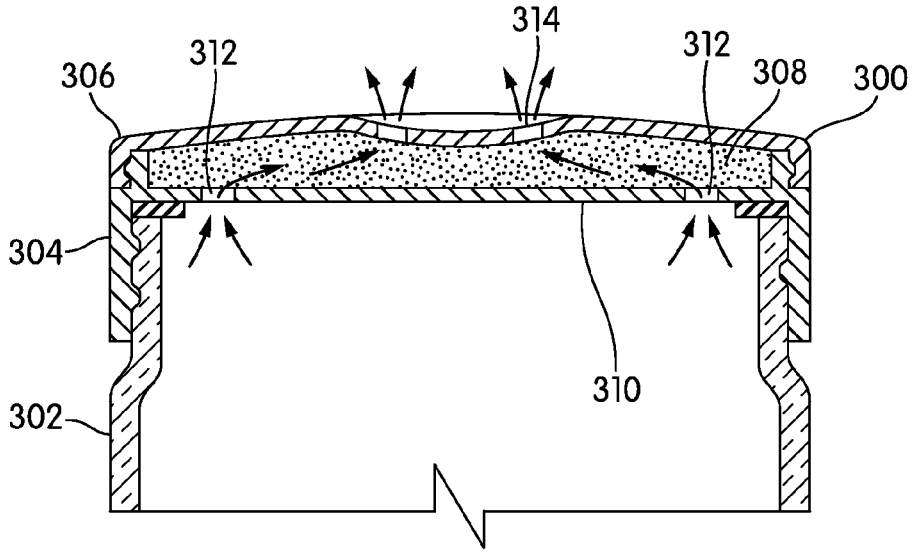
FIG. 35 is a cross-sectional view of a closure coupled to a container according to an exemplary embodiment.
Figure 36:
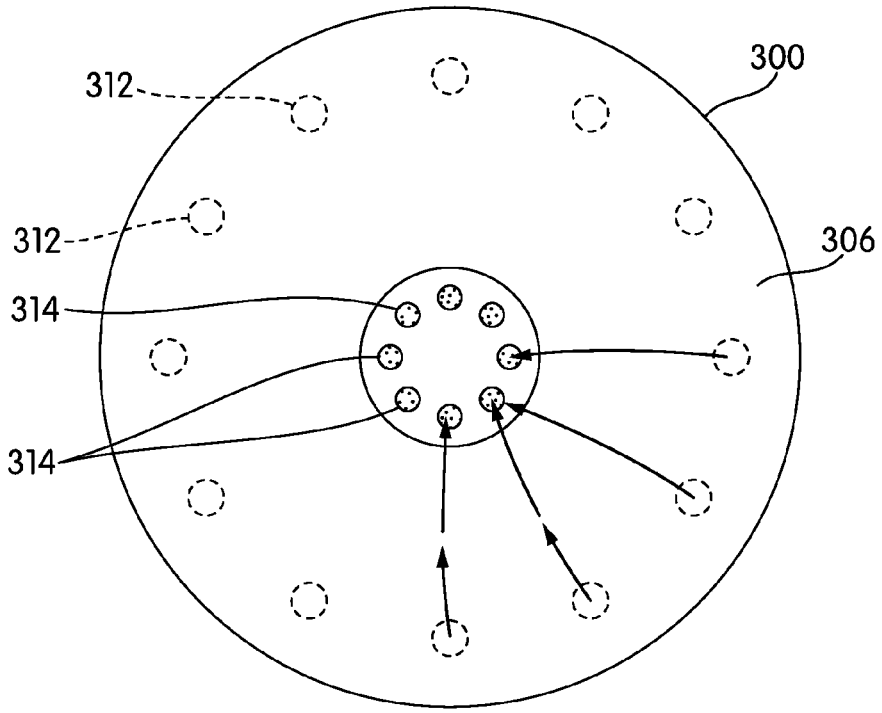
FIG. 36 is a top view of a closure according to an exemplary embodiment.

With reference to FIGS. 35 and 36, another embodiment of a closure 300 is illustrated coupled to a container 302. The closure 300 includes a lower portion 304 and an upper portion 306 coupled to the lower portion 304. The upper portion 306 is coupled to the lower portion 304 by, e.g., a snap fit, interference fit, etc. The lower portion 304 includes a coupling mechanism, shown in FIG. 35 as threading, configured to couple the closure 300 to the container 302. A filter 308 is located between the upper portion 306 and the lower portion 304. The lower portion 304 includes an intermediate wall 310. The intermediate wall 310 defines a plurality of vents 312 proximate its radial periphery. The upper portion 306 defines a plurality of vents 314 arranged in a generally circular array distal from its radial periphery and proximate its central longitudinal axis. The vents 312 and the vents 314 extend along longitudinal axes that are non-coaxial. Gas from the interior of the container 302 passes axially through the vents 312 and both axially upwardly and radially inwardly through the filter 308 to the vents 314 to escape from the closure 300. This path provides additional exposure of the gas to the filter 308, e.g., compared to a path that is only axial (for example, a path that does not include a radial component) through the filter 308.

Figure 37:
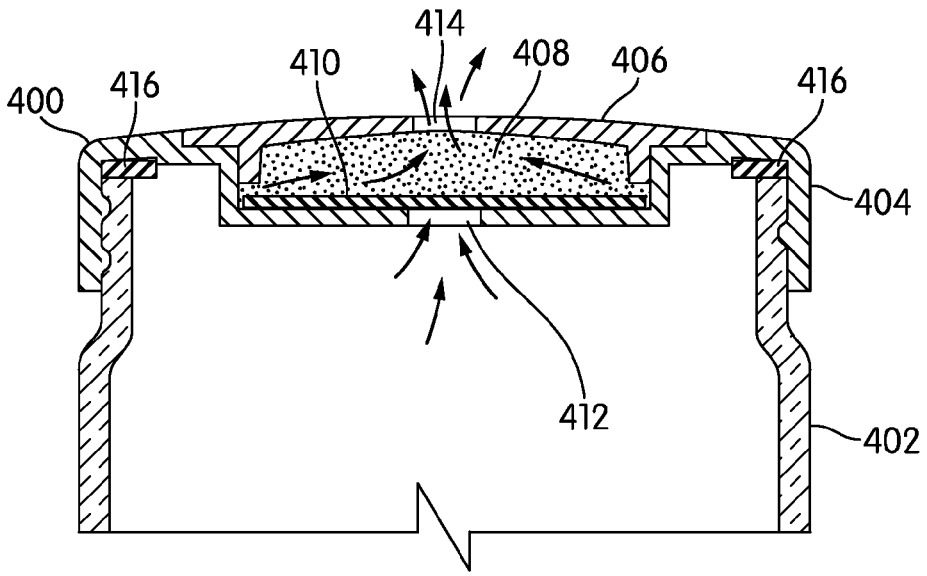
FIG. 37 is a cross-sectional view of a closure coupled to a container according to an exemplary embodiment.
Figure 38:
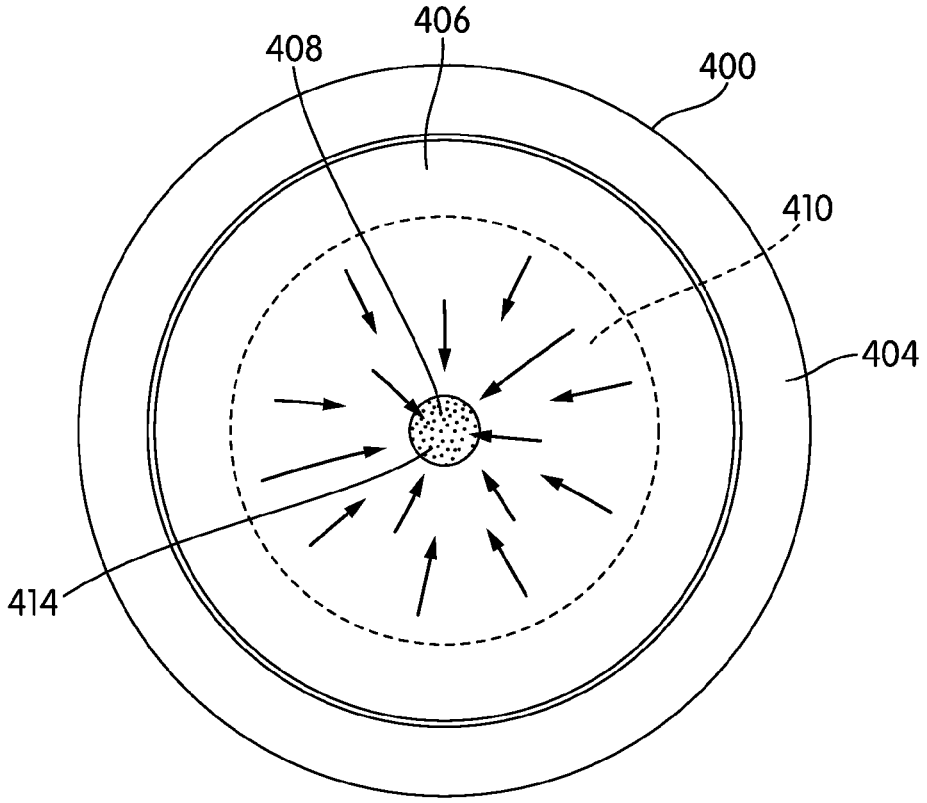
FIG. 38 is a top view of a closure according to an exemplary embodiment.

With reference to FIGS. 37 and 38, another embodiment of a closure 400 is illustrated coupled to a container 402. The closure 400 includes a lower portion 404, an upper portion 406 coupled to the lower portion 404, a filter 408 located between the upper portion 406 and the lower portion 404, and a valve, shown in FIG. 37 as a silicone sheet vent valve 410, located between the filter 408 and the lower portion 404. The lower portion 404 defines a vent 412 in communication with the interior of the container 402. The valve 410 overlays the vent 412 such that gas from the interior of the container 402 passes through the vent 412 and is forced by the valve 410 to travel radially outwardly to the radial periphery of the valve 410 before the gas can move axially upwardly through the filter 408. The upper portion 406 defines a vent 414 located proximate the radial center of the upper portion 406. Gas travels radially inwardly and axially upwardly from the radial periphery of the valve 410 through the filter 408 to the vent 414. This path provides additional exposure of the gas to the filter 408 compared to a path that is only axial through the filter 408, e.g., a path from the vent 412 to the vent 414 if the valve 410 were removed. In one embodiment, the closure 400 also includes a seal, shown in FIG. 37 as a ring seal 416, configured to seal between the lower portion 404 and the finish of the container 402 to prevent contents, e.g., liquid and gas, of the container 402 from escaping between the lower portion 404 and the finish of the container 402.

Figure 39:
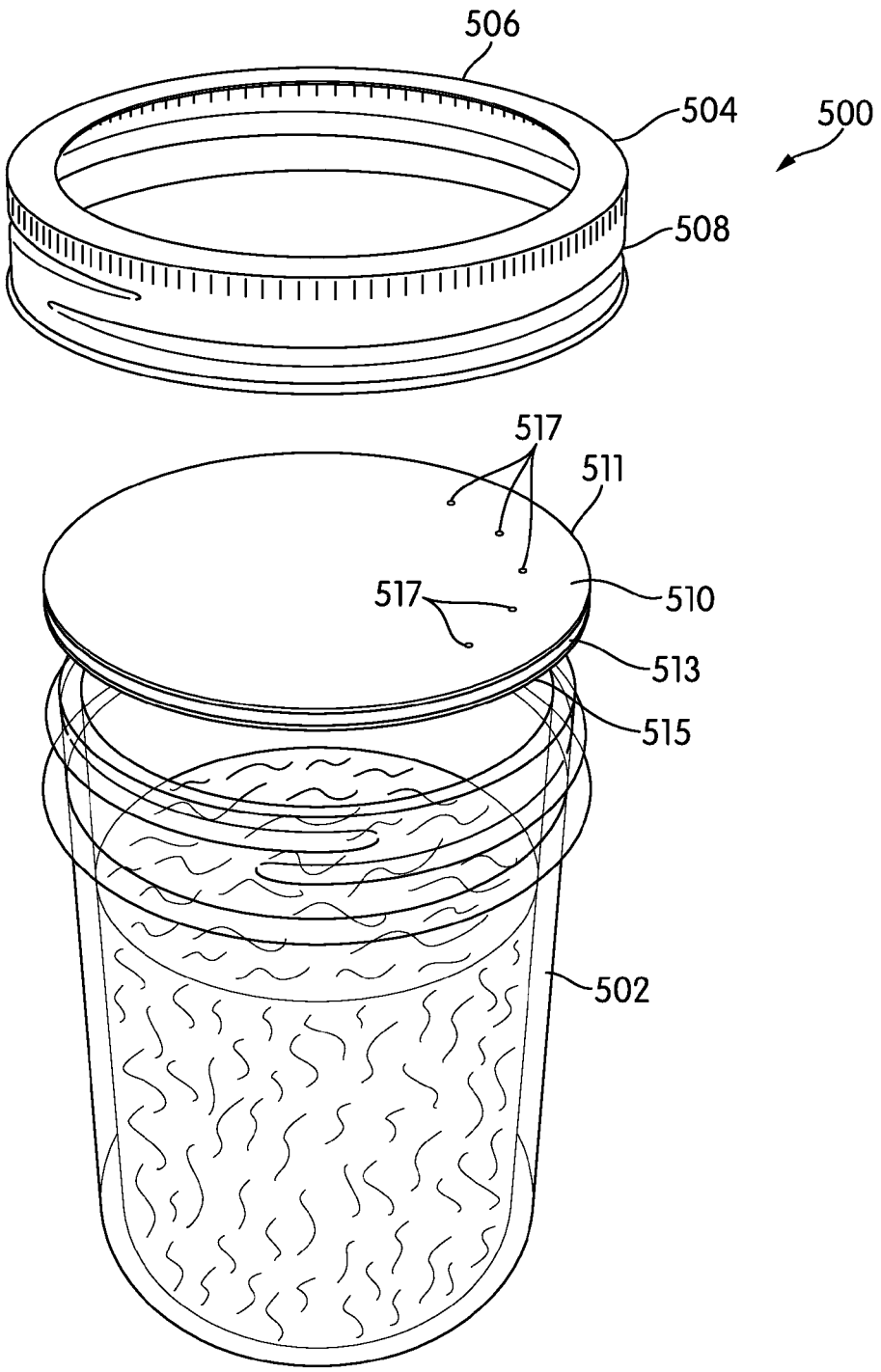
FIG. 39 is an exploded view of a closure and a container according to an exemplary embodiment.
Figure 40:
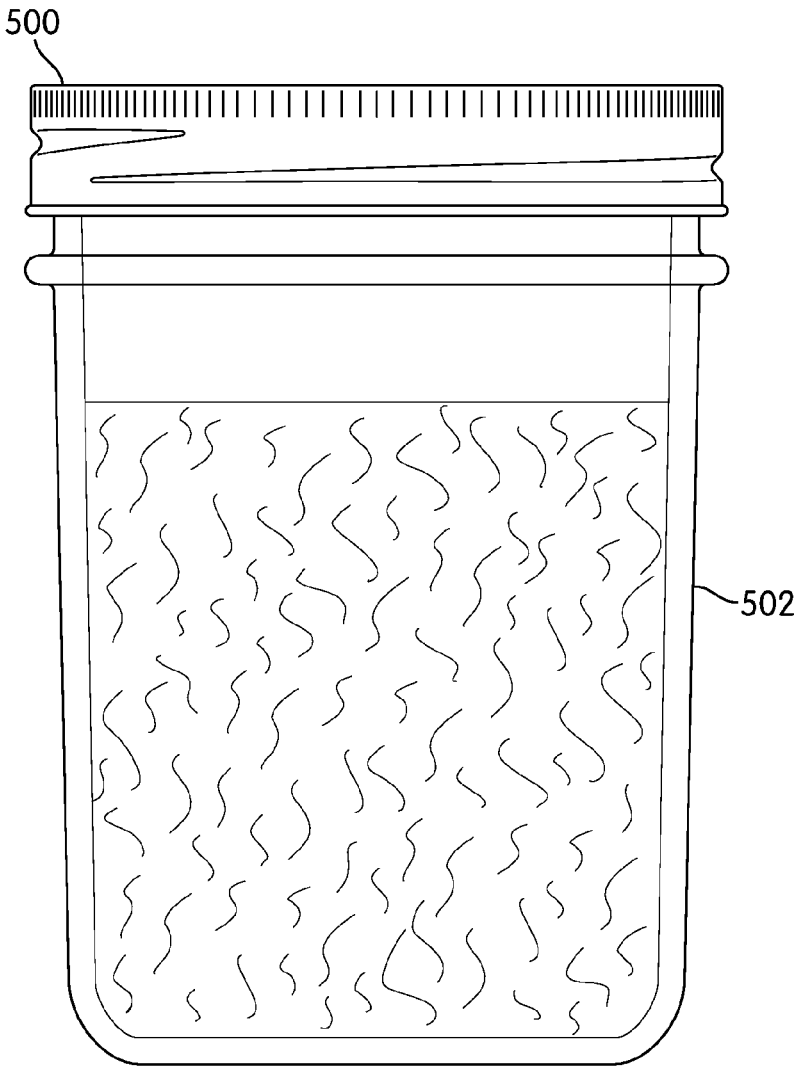
FIG. 40 is a side view of a closure coupled to a container according to an exemplary embodiment.

With reference to FIGS. 39 and 40, another embodiment of a closure 500 is illustrated. The closure 500 is shown in an exploded configuration in FIG. 39 and coupled to a container 502 in FIG. 40. The closure 500 includes an upper portion 504. The upper portion 504 includes an annular upper ring portion 506 defining a central opening and sidewall 508 extending axially downwardly from the radial periphery of the annular ring portion 506. The sidewall 508 is configured to couple the upper portion 504 to the sidewall of the container 502. The closure 500 also includes a filter portion 510. The filter portion 510 is separable from the upper portion 504 and is configured to be located within the sidewall 508 of the upper portion 504 to filter gas passing from the interior of the container 502 to the outside of the closure 500. The filter portion 510 includes an upper layer 511, e.g., formed from a fluid impermeable material such as plastic. The filter portion 510 also includes a filter material layer 513 below the upper layer 511. The filter portion 510 also includes a lower layer 515, e.g., formed from a fluid impermeable material such as plastic. The upper and lower layers 511 and 515 are adhered to the filter material layer 513. At least one aperture is defined in the lower layer 515 (not visible in FIGS. 39 and 40). A plurality of apertures 517 are defined in the upper layer 511. The apertures 517 in the upper layer 511 are not aligned with the at least one aperture in the lower layer 515. Gas from the interior of a container flows through the aperture in the lower layer 515, through the filter material layer 513 and out through the apertures 517 in the upper layer 511. The filter portion 510 is configured such that the upper and lower layers 511 and 515 can be detached from the filter material layer 513 after use so that the upper and lower layers 511 and 515 and the filter material layer 513 can be separately disposed of, e.g., the upper and lower layers 511 and 515 may be recycled.

Figure 41:
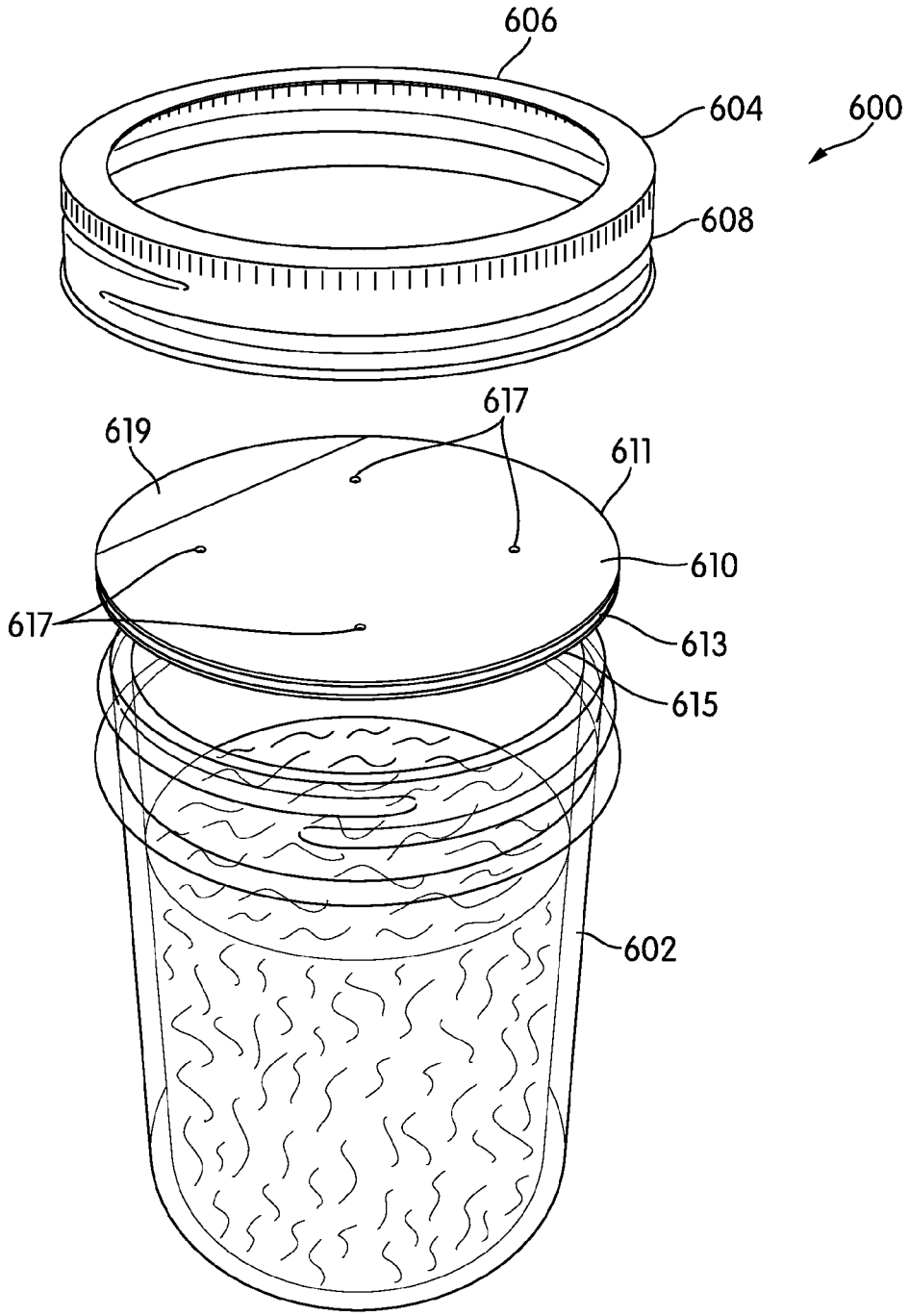
FIG. 41 is an exploded view of a closure and a container according to an exemplary embodiment.

With reference to FIG. 41, another embodiment of a closure 600 is illustrated. The closure 600 is shown in an exploded configuration in FIG. 41. The closure 600 includes an upper portion 604. The upper portion 604 includes an annular upper ring portion 606 defining a central opening and sidewall 608 extending axially downwardly from the radial periphery of the annular ring portion 606. The sidewall 608 is configured to couple the upper portion 604 to the sidewall of the container 602. The closure 600 also includes a filter portion 610. The filter portion 610 is separable from the upper portion 604 and is configured to be located within the sidewall 608 of the upper portion 604 to filter gas passing from the interior of the container 602 to the outside of the closure 600. The filter portion 610 is configured similarly to the filter portion 510, with an upper layer 611, a filter material layer 613, and a lower layer 615. The apertures 617 are configured differently than the apertures 517. In one embodiment, the apertures 617 are not aligned with the at least one aperture in the lower layer 615 (not visible in FIG. 41). In one embodiment, the upper and lower 611 and 165 layers are configured to be removed from the filter material layer 613 after use. The upper layer is provided with a pull tab portion 619 configured to facilitate removal, e.g., peeling, of the upper layer 611 from the filter material layer 613.

Figure 42:
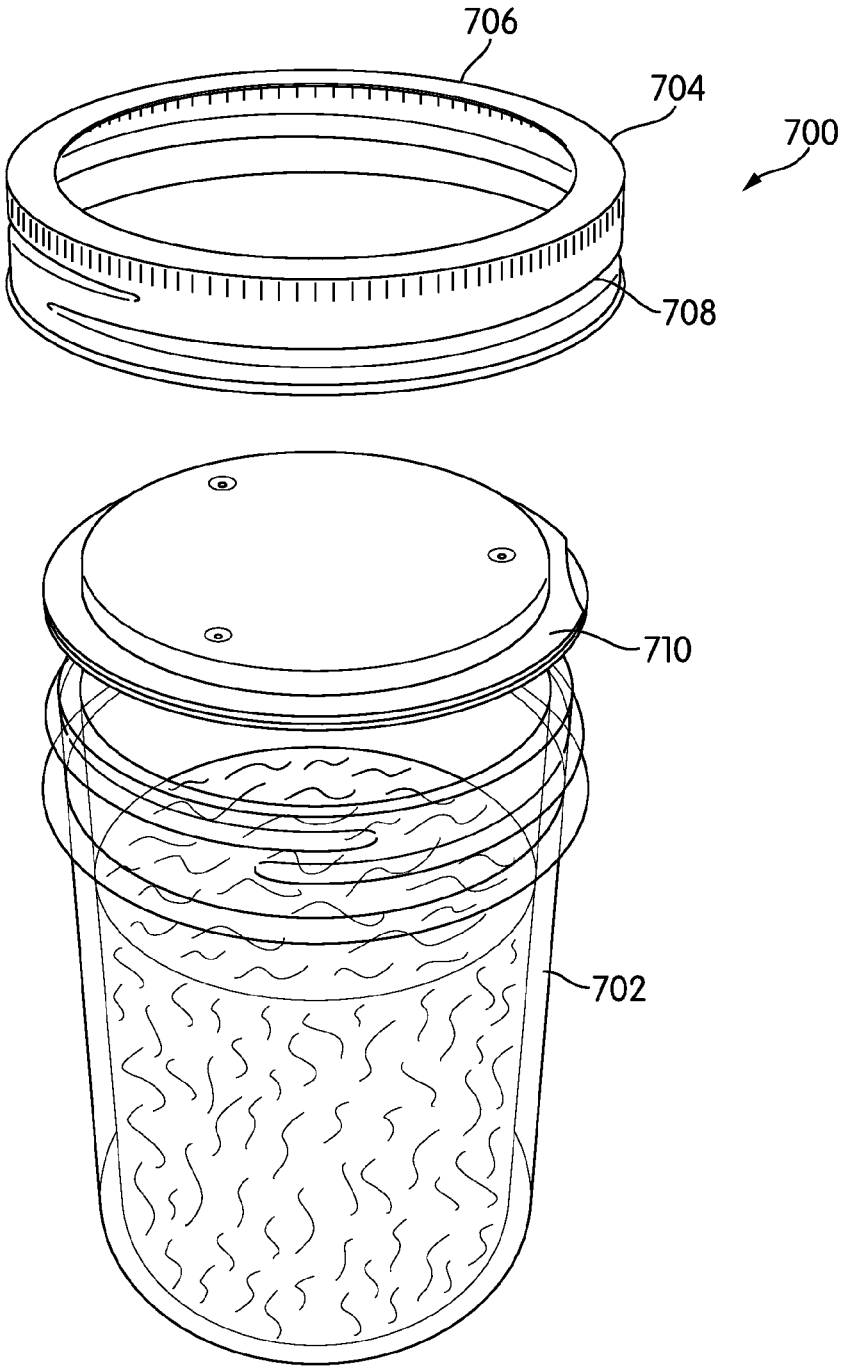
FIG. 42 is an exploded view of a closure and a container according to an exemplary embodiment.
Figure 43:
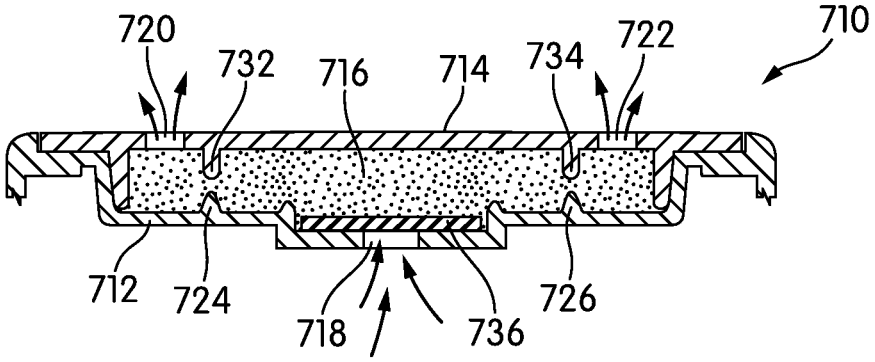
FIG. 43 is a cross-sectional view of a filter according to an exemplary embodiment.
Figure 44:
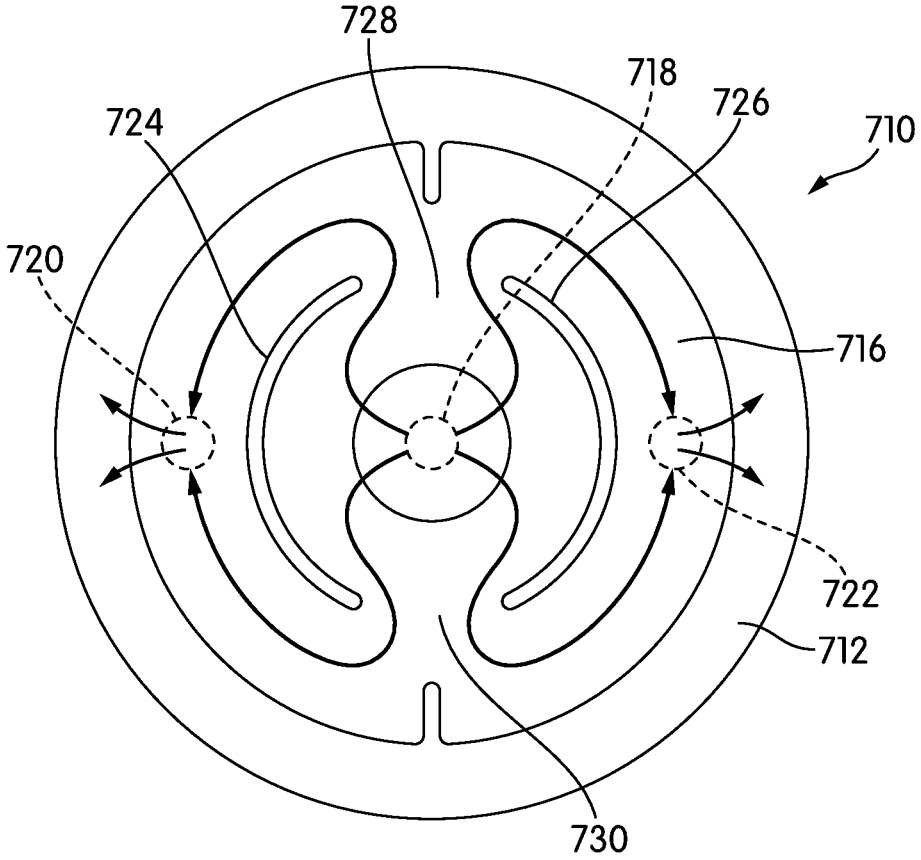
FIG. 44 is a top view of a filter with an upper portion removed according to an exemplary embodiment.

With reference to FIGS. 42-44, another embodiment of a closure 700 is illustrated. The closure 700 is shown in an exploded configuration in FIG. 42. The closure 700 includes an upper portion 704. The upper portion 704 includes an annular upper ring portion 706 defining a central opening and sidewall 708 extending axially downwardly from the radial periphery of the annular ring portion 706. The sidewall 708 is configured to couple the upper portion 704 to the sidewall of the container 702. The closure 700 also includes a filter portion 710. The filter portion 710 may be separable from the upper portion 704 and may be configured to be located within the sidewall 708 of the upper portion 704 to filter gas passing from the interior of the container 702 to the outside of the closure 700. With reference to FIGS. 43 and 44, in one embodiment, the filter portion 710 includes a lower wall 712 and an upper wall 714 coupled to the lower wall 712. A filter, shown in FIGS. 43 and 44 as a compressed foam filter 716, such as, for example, a fibrous foam charcoal impregnated filter, is located between the upper wall 714 and the lower wall 712. The lower wall 712 defines a central vent 718. The upper wall 714 defines a pair of radially peripheral vents 720 and 722 located radially outwardly from the central vent 718. The radially peripheral vents 720 and 722 are spaced apart approximately 180° from one another. The lower wall 712 includes an axially upwardly projecting first arched rib 724 located radially between the central vent 718 and the radially peripheral vent 720 and an axially upwardly projecting second arched rib 726 located radially between the central vent 718 and the radially peripheral vent 722. A first gap 728 and a second gap 730 are defined between the ends of the ribs 724 and 726. The upper wall 714 includes an axially downwardly projecting first arched rib 732 generally axially aligned with the first arched rib 724 of the lower wall 712. The upper wall 714 includes an axially downwardly projecting second arched rib 734 generally axially aligned with the second arched rib 726.

In one embodiment, the closure 700 also includes a one-way elastomeric disk valve 736, e.g., silicone elastomeric disk, located over the central vent 718. The valve 736 may be configured to prevent wetting of the filter 716 by fluid in the container 702, may protect from spillage of the contents of the container 702 if the container 702 is tipped over, may isolate the filter 716 from the contents of the container 702, may allow for venting of fermentation gas from the interior of the container 702 at a predetermined container pressure, and may prevent environmental gases, e.g., oxygen, from reaching the contents of the container 702 to prevent mold growth in the container 702. In one embodiment, the disk valve 736 is held in position under the compressed foam filter 716.

In one embodiment, the ribs 724, 726, 732, and 734 pinch the filter 716. This may create impingement to direct vapor flow to the vents 720, instead promoting vapor flow in the paths illustrated in FIG. 44. When gas from the container 702 passes through the central vent 718, to the radial periphery of the valve 736 and axially upwardly into the filter 716, the ribs 724, 726, 732, and 734 generally deter the gas from passing directly radially toward the peripheral vents 720 and 722, but instead promote movement of the gas toward the gaps 728 and 730 and then toward the peripheral vents 720 and 722. Thus, the ribs 724, 726, 732, and 734 may be used to create a circuitous elongated flow path through the filter 716 which may increase exposure of the gas to the filter 716 and may increase effectiveness of the filter 716 of removing from the gas those contents of the gas tending to exhibit objectionable and/or noxious odors. In one embodiment, the filter 716 may tend to urge the valve 736 against the lower wall 712.

Figure 45:
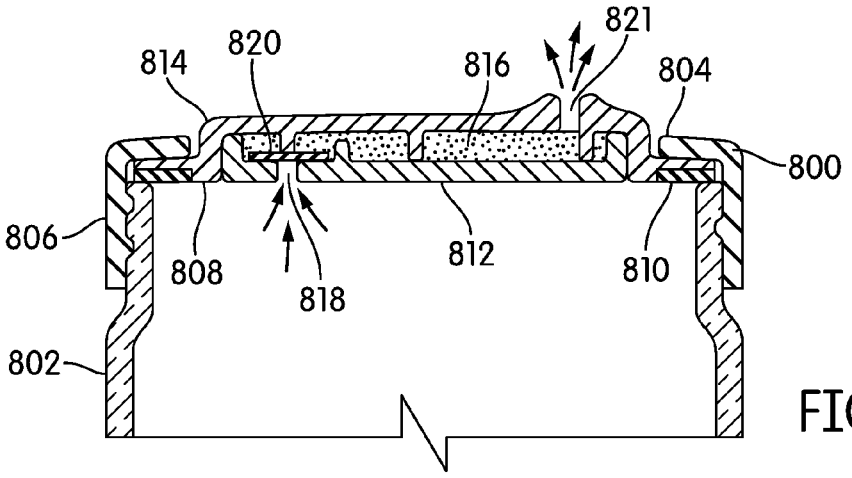
FIG. 45 is a cross-sectional view of a closure coupled to a container according to an exemplary embodiment.
Figure 46:
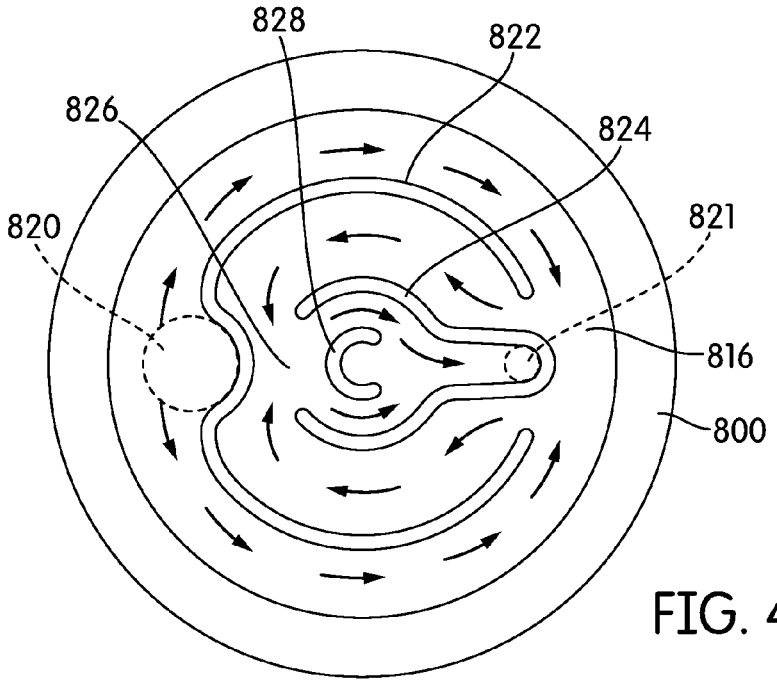
FIG. 46 is a top view of a closure with an upper portion removed according to an exemplary embodiment.
Figure 47:
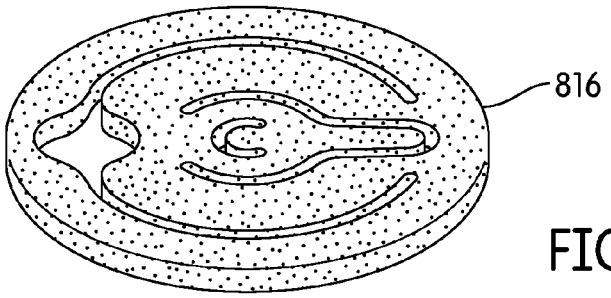
FIG. 47 is a perspective view of a fabric disk according to an exemplary embodiment.

With reference to FIGS. 45-47, another embodiment of a closure 800 is illustrated. The closure 800 is configured to be coupled to a container 802, such as a glass mason jar, etc. The closure 800 includes a ring 804 defining a central opening and a sidewall 806 extending axially downwardly from the radial periphery of the ring 804, the sidewall 806 configured to couple the closure 800 to the container 802. The closure 800 includes a disk insert 808 configured to be located between the finish of the container 802 and the ring 804. The disk insert 808 includes a seal, shown in FIG. 45 as an overmolded seal 810, configured to seal with the finish of the container 802. The disk insert 808 includes a lower wall 812 and an upper wall 814 coupled to the lower wall 812. Located between the upper wall 814 and the lower wall 812 is a filter, shown as a non-woven carbon fabric disk 816. In one embodiment, the filter is die-cut. In another embodiment, the filter is laser cut. In other embodiments, other suitable forming techniques may be used. The lower wall 812 defines a vent 818 proximate the radial periphery of the lower wall 812. The disk insert 808 includes a valve 820 configured to regulate fluid flow through the vent 820. The upper wall 814 defines a vent 821 proximate its radial periphery radially separated from the vent 818 by approximately 180°. The vent 821 has a raised radial periphery configured to prevent blockage. In one embodiment, the radial periphery of the vent 821 may be configured to deter blocking of the vent 821, deter a covering being accidentally placed thereon, preventing flow through the vent 821. Extending through the fabric disk 816 is a rounded wall portion 822. The rounded wall portion 822 prevents gas travelling through the filter 816 from travelling directly radially from the vent 818 to the vent 821. The rounded wall portion 822 defines a path around the radial periphery of the fabric disk 816, as shown in FIG. 46. Also extending through the fabric disk 816 is a second rounded wall 824. The second rounded wall 824 prevents gas travelling through the fabric disk 816 from moving directly from the location to which it is directed by the first rounded wall 822 to the vent 821. Instead, the second rounded wall 824 and the radially inner surface of the first rounded wall 822 define a path in a direction generally back toward the valve 820, as shown in FIG. 46. The second rounded wall 824 defines a gap 826 through which gas may travel through the fabric disk 816 toward the vent 821. Also extending through the fabric disk 816 is a third divider wall 828. The divider wall 828 is configured to divert gas travelling through the fabric disk 816 around the divider wall 828 to reach the vent 821. The walls 822, 824, and 826 are configured to promote gas flow in a path through the fabric disk 816 in a path that may increase exposure of the gas to the fabric disk 816 and may increase the filtering effectiveness of the fabric disk 816 of removing from the gas those contents of the gas tending to exhibit objectionable and/or noxious odors as compared to gas taking a direct path from the vent 818 to the vent 821.

Figure 48:
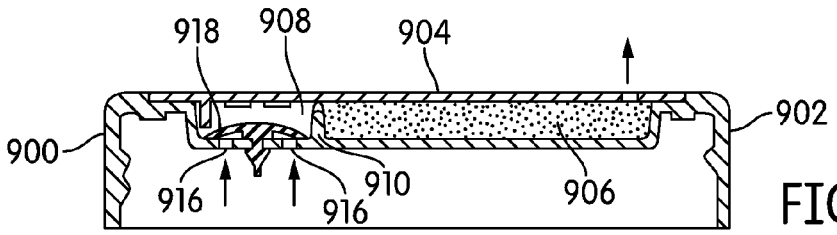
FIG. 48 is a cross-sectional view of a closure according to an exemplary embodiment.
Figure 49:
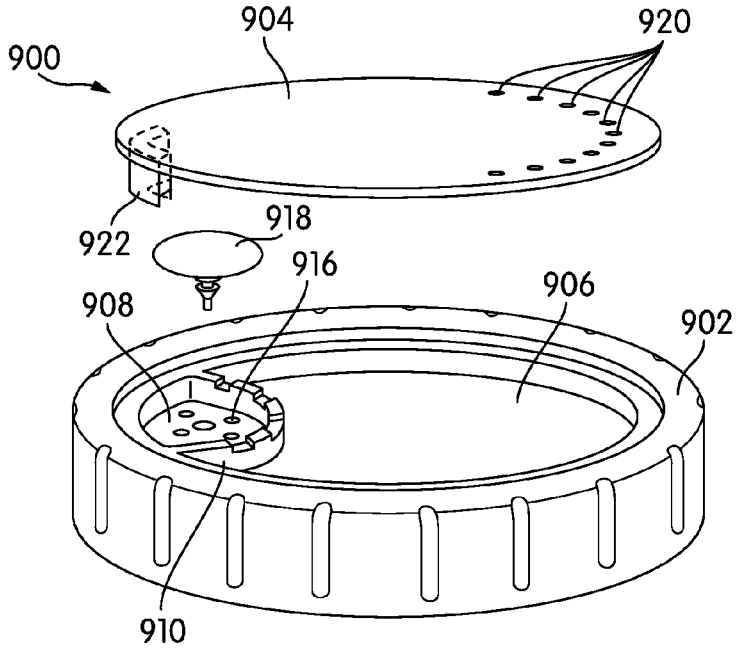
FIG. 49 is an exploded view of a closure according to an exemplary embodiment.
Figure 50:
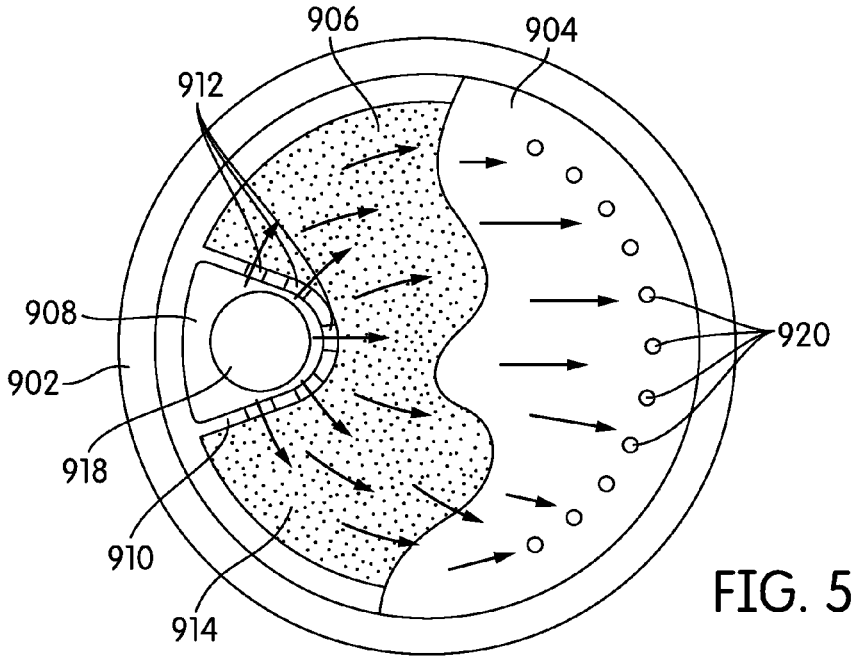
FIG. 50 is a top view of a closure with an upper portion removed according to an exemplary embodiment.

With reference to FIGS. 48-50, another embodiment of a closure 900 is illustrated. The closure 900 has a lower portion 902 and an upper portion 904 coupled to the lower portion 902. In one embodiment, the upper portion 904 is coupled to the lower portion 902 by an ultrasonic weld seal. In other embodiments, other suitable coupling mechanisms may be used. The lower portion 902 defines a first compartment 906 and a second compartment 908 divided by a wall 910. The wall 910 has a plurality of apertures 912 defined therein proximate its axial periphery. The first compartment 906 is configured to receive filter material 914, shown in FIGS. 48 and 50 as loose charcoal granules. A plurality of vents 916 extending through the lower portion 902 provide fluid communication between the interior of a container to which the closure 900 is coupled and the second compartment 908. A valve, shown in FIGS. 48-50 as a pull-through, snap-fit, one-way, umbrella valve configured to prevent flow of liquid from the interior of the container to which the closure 900 is coupled into the second compartment 908 and to allow flow of gas from the interior of the container to which the closure 900 is coupled into the second compartment 908. The wall 910 is configured to isolate the valve 918 from the filter material 914. Gas from the interior of a container to which the closure 900 is coupled passes through the vents 916, past the valve 918, into the second compartment 908, through the apertures 912 in the wall 910 and into the first compartment 906. The upper portion 904 includes a plurality of vents 920 located radially distal from the vents 916. The gas from the interior of the container to which the closure 900 is coupled passes through the filter material 914 in an elongated flow path, e.g., through loose charcoal granules, to the vents 920 to exit the closure. In one embodiment, the upper portion 904 includes an alignment feature, shown as an axially downwardly extending alignment rib key 922. The key 922 is configured to interact with an alignment feature of the lower portion 902 to allow the upper 904 and lower 902 portions to be coupled together when the key 922 and the alignment feature of the lower portion 902 are properly aligned and to prevent coupling of the upper 904 and lower 902 portions when the key 922 and the alignment feature of the lower portion 902 are not properly aligned. FIG. 50 is shown with a portion of the upper portion 904 removed for clarity.

Figure 51:
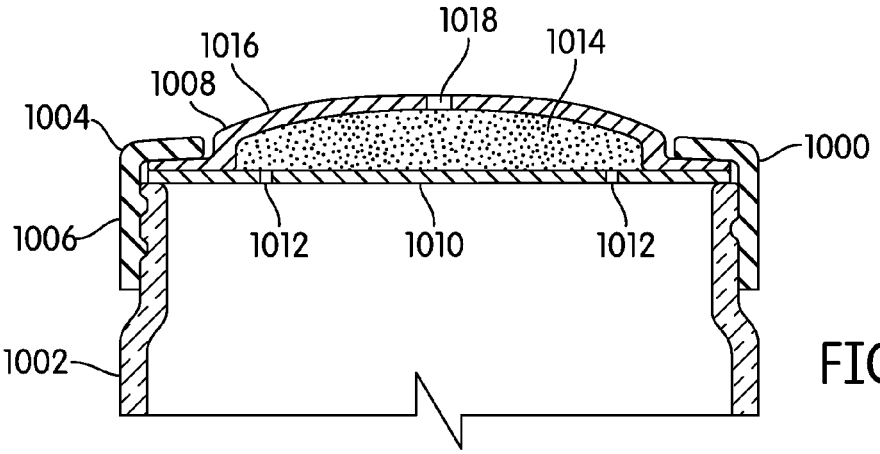
FIG. 51 is a cross-sectional view of a closure coupled to a container according to an exemplary embodiment.
Figure 52:
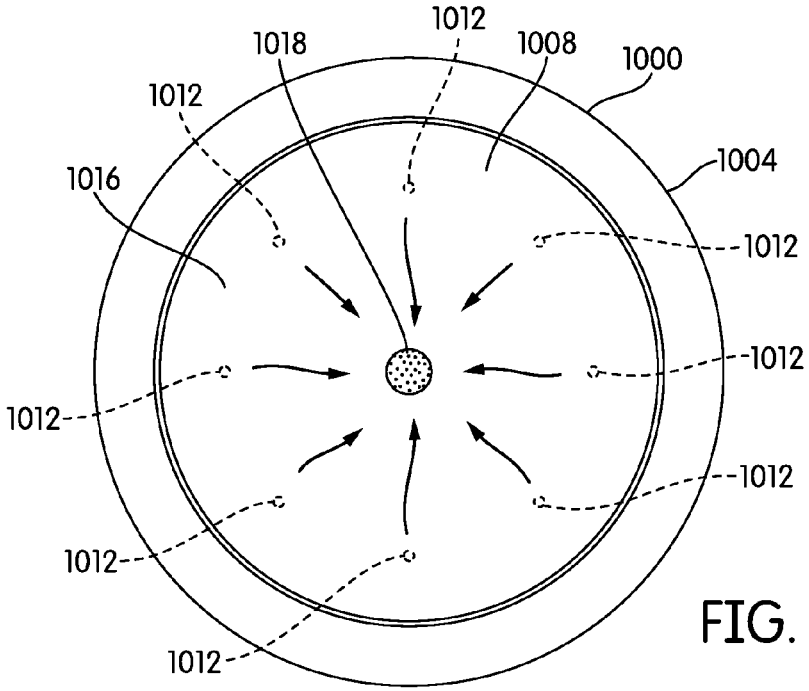
FIG. 52 is a top view of a closure according to an exemplary embodiment.

With reference to FIGS. 51 and 52, another embodiment of a closure 1000 is illustrated. The closure 1000 is configured to be coupled to a container 1002, such as a glass mason jar, etc. The closure 1000 includes a ring 1004 defining a central opening and a sidewall 1006 extending axially downwardly from the radial periphery of the ring 1004, the sidewall 1006 configured to couple the closure 1000 to the container 1002. The closure 1000 includes a filter insert 1008 configured to be located between the finish of the container 1002 and the ring 1004. The insert 1008 includes a lower layer, shown as an elastomeric sheet 1010. Defined in the elastomeric sheet 1010 proximate its radial periphery are a plurality of apertures 1012, e.g., holes, slits, etc. The apertures 1012 in the elastomeric sheet 1010 are sized and configured to act as one-way valves allowing gas to past through from the interior of the container 1002, but to prevent gas from passing into the interior of the container 1002 through the apertures 1012 from the exterior. The insert 1008 includes a filter layer 1014 located on the elastomeric sheet 1010, including over the apertures 1012. The insert 1008 also includes an upper layer 1016. Defined in the upper layer 1016 proximate its center is a vent 1018. The upper layer 1016 curves axially downwardly in a radially outwardly direction. The filter layer 1014 proximate its radial periphery, e.g., over the apertures 1012, may be compressed, e.g., more densely packed, between the downwardly sloping portion of the upper layer 1016 and the elastomeric sheet 1010. This may provide for increased filtering efficiency of the filter layer 1014. Fluid from the container 1002 flows through the apertures 1012, radially inwardly and axially upwardly through the filter layer 1014 to the vent 1018 and out from the closure 1000.

In one embodiment, the ring 1004 and sidewall 1006 may be formed from a different material, e.g., metal, than the filter insert 1008. In other embodiments, the ring 1004 and sidewall 1006 may be formed from other suitable materials.

Figure 53:
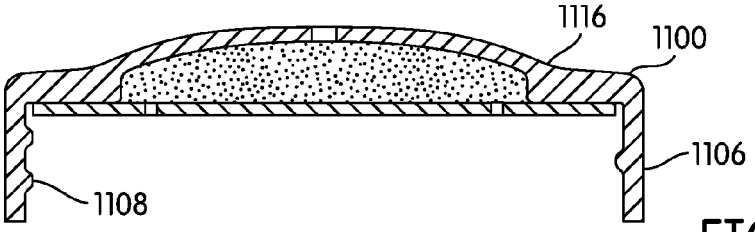
FIG. 53 is a cross-sectional view of a closure according to an exemplary embodiment.

With reference to FIG. 53, another embodiment of a closure 1100, with similarities to closure 1000, is illustrated. The closure 1100 includes a sidewall 1106 integrally formed with the upper layer 1116. The sidewall 1106 includes a coupling feature, shown in FIG. 53 as threading 1108, configured to couple the closure 1100 to a container.

Figure 54:
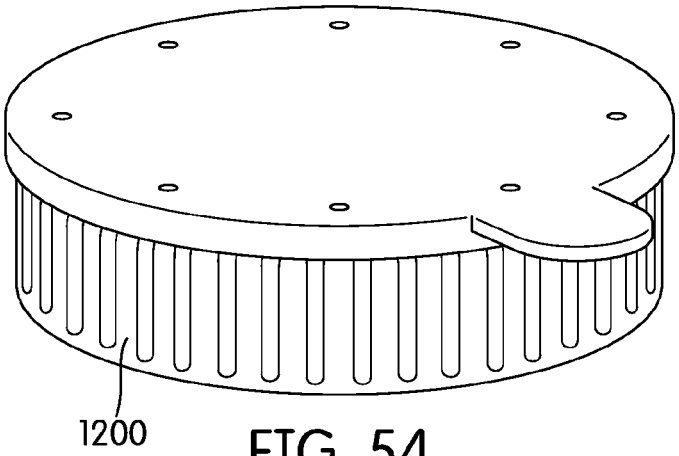
FIG. 54 is a perspective view of another embodiment of a closure according to an exemplary embodiment.
Figure 55:
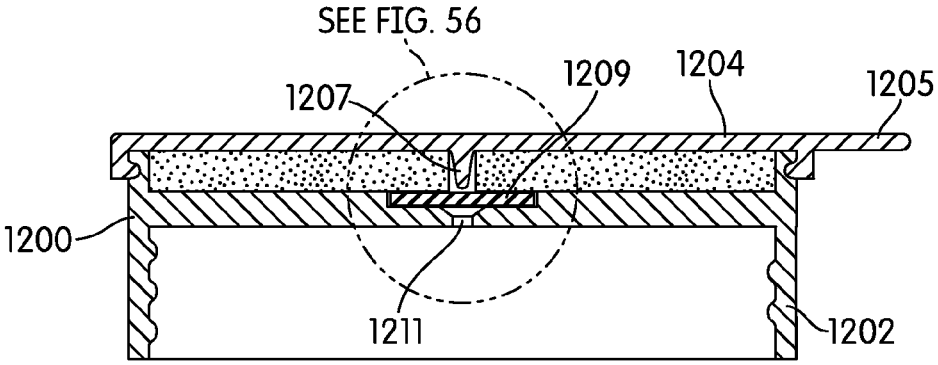
FIG. 55 is a cross-sectional view of a closure according to an exemplary embodiment.
Figure 56:
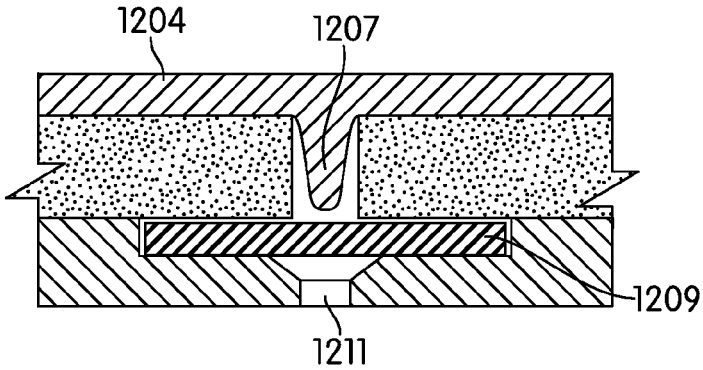
FIG. 56 is a detail view of the area 56 in FIG. 55.

With reference to FIGS. 54-56, another embodiment of a closure 1200 is illustrated. The upper portion 1204 of the closure 1200 includes a tab 1205 projecting radially outwardly farther than the lower portion 1202. In one embodiment, the tab 1205 is integrally formed with the upper portion 1204. The tab 1205 is configured to be grasped and pulled upwardly by a user to facilitate removal of the upper portion 1204 from the lower portion 1202. The upper portion 1204 also includes a projection 1207 projecting axially downwardly configured to maintain the valve 1209 in place over the vent aperture 1211 in the lower portion 1202.

In exemplary embodiments, the bores in the upper and lower portions of closures described herein are dimensioned and configured to allow gas to flow therethrough, but to generally impede the flow of liquid therethrough. In exemplary embodiments, the closures described herein are configured to allow release of gases from the fermentation process in a container over time during fermentation, e.g., in contrast to gases being released only at the time of opening a closure and removing it from a container.

In exemplary embodiments, the flow paths of gas through filters described herein may be configured to increase the length of effective life of the filters by utilizing more of the filter material when compared to a direct axial flow path between bores or vents through the filter material.

In exemplary embodiments, indicia, e.g., company names, logos, trademarks, etc., may be integrally molded onto closures.

In exemplary embodiments, the valves described herein may be configured with a low bias toward a closed configuration, e.g., valves may be configured to minimize opportunity for liquids to escape from a container to which a closure is coupled, for example, if the container is tipped over, but also configured not to appreciably confine fermentation gases located in the container.

In exemplary embodiments, closures described herein may be washable and/or reusable. In exemplary embodiments, upper and lower portions of closures may be coupled together by annular snap engagement and may be configured to facilitate removal and replacement of filter material. In exemplary embodiments, upper and lower portions of closures may be coupled together to capture and confine filter material and may be recycled. In exemplary embodiments, upper portions may be radially internally coupled to lower portions. In exemplary embodiments, closures described herein may be formed of FDA food grade materials and may be formed from materials that do not contain Bisphenol A. In exemplary embodiments, closures may be formed by injection molding. In other embodiments, other suitable forming methods may be used. In exemplary embodiments, upper and lower portions of closures may be similarly or dissimilarly colored. In exemplary embodiments, closures may be configured to be coupled to various types of containers, e.g., glass mason jars, molded glass jars, jars with screw threads configured to receive a metal ring, or other suitable types of containers.

In exemplary embodiments, closures described herein are configured to prevent gas from travelling in a path generally parallel to the longitudinal axis from the first vent aperture to the second vent aperture, e.g., gas is not allowed to travel only axially through the filter, but instead travels both axially and radially to pass through the filter and out of the closure.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

In one embodiment, portions of the closures described here, e.g., upper and lower portions, may be formed from plastic, e.g., low density polyethylene, high density polyethylene, polyethylene terephthalate, polyvinyl chloride, polytetrafluoroethylene, polypropylene, etc. In one embodiment, portions of the closure may be formed from thermosetting plastic. In another embodiment, portions of the closure may be formed from thermoplastic. In other embodiments, other suitable materials may be used. In one embodiment, the upper portion of a closure is more deformable than the lower portion of the closure to allow the upper portion to be deformed to remove it, e.g., decouple it from the lower portion.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A closure configured to be coupled to a container having a sidewall extending along a longitudinal axis and defining an open end and an interior, the closure comprising:

a sidewall including an inner surface and an outer surface, the inner surface including a coupling feature configured to couple the closure to the sidewall of a container;

an intermediate wall extending radially inwardly from the sidewall including a first vent aperture;

an upper closure portion including a second vent aperture;

a filter layer located between the upper closure portion and the intermediate wall; wherein the closure is configured to prevent gas from travelling in a path generally parallel to the longitudinal axis from the first vent aperture to the second vent aperture; and further comprising a one-way valve controlling flow through the first vent aperture.

2. The closure of claim 1, wherein the one-way valve is configured to allow vapor flow through the first vent aperture when the pressure within the container is greater than a predetermined pressure.

3. A closure configured to be coupled to a container having a sidewall extending along a longitudinal axis and defining an open end and an interior, the closure comprising:

a sidewall including an inner surface and an outer surface, the inner surface including a coupling feature configured to couple the closure to the sidewall of a container;

an intermediate wall extending radially inwardly from the sidewall including a first vent aperture;

an upper closure portion including a second vent aperture;

a filter layer located between the upper closure portion and the intermediate wall; wherein the closure is configured to prevent gas from travelling in a path generally parallel to the longitudinal axis from the first vent aperture to the second vent aperture; and wherein the sidewall includes a plurality of radially inwardly projecting ribs configured to locate the filter layer.

4. A closure configured to be coupled to a container having a sidewall extending along a longitudinal axis from a first open end to a second end and defining an interior, the closure comprising:

a filter;

a compartment enclosing the filter in its interior, the compartment defined by an upper wall and a lower wall, the lower wall including a first through bore, the upper wall including a second through bore, the second through bore extending from an inner aperture in the interior of the upper wall in communication with the interior of the compartment and an outer aperture in the exterior of the upper wall in communication with the exterior of the closure;

a sidewall having an interior surface and an exterior surface, the interior surface including a coupling feature configured to couple the closure to the sidewall of the container;

wherein the first through bore extends along a first axis, wherein the second through bore extends along a second axis, and wherein the first axis and the second axis are non-coaxial; and wherein the lower wall includes a central portion and an axially upwardly extending outer wall portion located at the radial periphery of the central portion, the filter being configured to be located on the central portion.

5. The closure of claim 4, wherein the first through bore is located in the center of the central portion.

6. A closure configured to be coupled to a container having a sidewall extending along a longitudinal axis from a first open end to a second end and defining an interior, the closure comprising:

a filter;

a compartment enclosing the filter in its interior, the compartment defined by an upper wall and a lower wall, the lower wall including a first through bore, the upper wall including a second through bore, the second through bore extending from an inner aperture in the interior of the upper wall in communication with the interior of the compartment and an outer aperture in the exterior of the upper wall in communication with the exterior of the closure;

a sidewall having an interior surface and an exterior surface, the interior surface including a coupling feature configured to couple the closure to the sidewall of the container;

wherein the first through bore extends along a first axis, wherein the second through bore extends along a second axis, and wherein the first axis and the second axis are non-coaxial; and wherein the upper wall includes a central circular portion and three protruding portions protruding radially outwardly from the central portion, each of the protruding portions being arranged approximately 120° from the other protruding portions.

7. The closure of claim 6, wherein the sidewall includes a plurality of ribs proximate each of the protruding portions, the ribs having radially outer surfaces extending non-parallel to a longitudinal axis of the sidewall.

8. A closure configured to be coupled to a container having a sidewall extending along a longitudinal axis from a first open end to a second end and defining an interior, the closure comprising:

a filter;

a compartment enclosing the filter in its interior, the compartment defined by an upper wall and a lower wall, the lower wall including a first through bore, the upper wall including a second through bore, the second through bore extending from an inner aperture in the interior of the upper wall in communication with the interior of the compartment and an outer aperture in the exterior of the upper wall in communication with the exterior of the closure;

a sidewall having an interior surface and an exterior surface, the interior surface including a coupling feature configured to couple the closure to the sidewall of the container, the lower wall directly connected to the sidewall;

wherein the first through bore extends along a first axis, wherein the second through bore extends along a second axis, and wherein the first axis and the second axis are non-coaxial; and comprising a valve configured to regulate fluid flow through the first through bore.

9. A closure confirmed to be coupled to a container having a sidewall extending from a first open end to a second end, the closure comprising:

a lower portion including a first sidewall extending along a longitudinal axis from a first end to a second end and a wall extending at an axial location between the first end of the first sidewall and the second end of the first sidewall, the wall including a first vent, the first sidewall configured to be coupled to the container;

a valve configured to regulate fluid flow through the first vent;

a filter; and an upper portion including a second sidewall extending from a first open end to a second end and an end wall, the end wall including a second vent, the second sidewall being configured to be coupled to the first sidewall to enclose the filter between the lower portion and the upper portion;

wherein the first vent and the second vent are each located at different radial locations relative to the longitudinal axis.

10. The closure of claim 9, wherein the first vent is coaxial with the longitudinal axis; and wherein the upper portion has a non-circular perimeter.

11. The closure of claim 9, wherein the wall includes an annular radially outer portion and a recessed radially inner portion defining an upper recess configured to receive the valve.

12. The closure of claim 9, wherein the lower portion includes a plurality of ribs with outer surfaces extending non-parallel with the longitudinal axis.

13. The closure of claim 9, wherein the wall of the lower portion defines a downwardly facing channel, the closure including a seal located in the downwardly facing channel.

14. A container comprising:

a first sidewall defining a first open end and an end wall closing a second end of the first sidewall, the first sidewall and the end wall defining a container chamber configured to receive vegetables to be fermented therein, the first sidewall having a threaded portion; and a closure including a second sidewall having threaded portion configured to threadingly engage with the threaded portion of the first sidewall to couple the closure to the sidewall and close the first open end of the first sidewall, the closure including an intermediate wall extending radially inwardly from the sidewall, the intermediate wall defining a first vent therethrough, the closure including a valve configured to regulate gas flow through the first vent and to deter liquid flow through the first vent, the closure including an upper wall defining a second vent therethrough, the upper wall and the intermediate wall defining a filter chamber therebetween, the closure including a filter located in the filter chamber;

wherein the intermediate wall and the valve are configured to isolate the filter from liquid and solid contents of the container chamber while allowing gas from the filter chamber to pass through the first vent to the filter.

* * * * *